US007311379B2

(12) United States Patent
Mitsuzawa

(10) Patent No.: US 7,311,379 B2
(45) Date of Patent: Dec. 25, 2007

(54) MULTI-PRINT HEAD PRINTING DEVICE

(75) Inventor: Toyohiko Mitsuzawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 359 days.

(21) Appl. No.: 10/465,818

(22) Filed: Jun. 20, 2003

(65) Prior Publication Data

US 2004/0046830 A1 Mar. 11, 2004

(30) Foreign Application Priority Data

Jun. 24, 2002 (JP) ..... 2002-183416

(51) Int. Cl.
*B41J 2/15* (2006.01)

(52) U.S. Cl. ..... 347/40

(58) Field of Classification Search ..... 347/5, 347/9, 12, 13, 20, 49, 85, 86, 40, 7; 358/296, 358/498

See application file for complete search history.

(56) References Cited

U.S. PATENT DOCUMENTS

| | | | | |
|---|---|---|---|---|
| 5,673,071 | A * | 9/1997 | Fuse | 347/35 |
| 5,710,634 | A * | 1/1998 | Kuriyama et al. | 358/296 |
| 5,860,080 | A * | 1/1999 | James et al. | 711/4 |
| 6,024,431 | A | 2/2000 | Takahashi et al. | |
| 6,056,454 | A * | 5/2000 | Plumley et al. | 400/120.16 |
| 6,109,723 | A * | 8/2000 | Castle et al. | 347/19 |
| 6,142,619 | A | 11/2000 | Miura et al. | |
| 6,224,198 | B1 * | 5/2001 | Cook et al. | 347/85 |
| 6,243,109 | B1 * | 6/2001 | Ishinaga et al. | 347/3 |
| 6,338,537 | B1 * | 1/2002 | Nou | 347/9 |
| 6,418,121 | B1 * | 7/2002 | Flickinger et al. | 370/242 |
| 6,467,863 | B1 | 10/2002 | Imanaka et al. | |
| 6,746,103 | B2 * | 6/2004 | Tanuma | 347/40 |
| 6,840,604 | B2 | 1/2005 | Kimura et al. | |
| 6,883,905 | B2 | 4/2005 | Kimura et al. | |
| 7,077,513 | B2 | 7/2006 | Kimura et al. | |
| 2001/0026300 | A1 * | 10/2001 | Yamaguchi et al. | 347/49 |
| 2002/0024549 | A1 | 2/2002 | Miura et al. | |
| 2002/0101471 | A1 * | 8/2002 | Shigeno | 347/24 |
| 2002/0149633 | A1 * | 10/2002 | Murakami et al. | 347/7 |
| 2002/0158954 | A1 | 10/2002 | Usui et al. | |
| 2003/0007040 | A1 * | 1/2003 | Love et al. | 347/85 |
| 2003/0174180 | A1 * | 9/2003 | Nunokawa | 347/5 |

FOREIGN PATENT DOCUMENTS

| | | | |
|---|---|---|---|
| JP | 05-212876 | A | 8/1993 |
| JP | 06246909 | A | 9/1994 |
| JP | 11251448 | A | 9/1999 |
| JP | 2001047630 | A | 2/2001 |
| JP | 2001-270125 | A | 10/2001 |
| JP | 2001-277658 | A | 10/2001 |
| JP | 2001-287365 | A | 10/2001 |
| WO | 0172522 | A1 | 4/2001 |

* cited by examiner

*Primary Examiner*—Stephen Meier
*Assistant Examiner*—Jason S Uhlenhake
(74) *Attorney, Agent, or Firm*—Sughrue Mion, PLLC

(57) ABSTRACT

A plurality of print heads 60 and drive controllers 330 are installable on a carriage 1. A plurality of data processors 320 for transferring data to the drive controllers 330 are installable on the chassis 300 of the printing device. Any circuit sets, each comprising a predetermined number of print heads 60, one drive controller 330, and one data processor 320, are individually installed and uninstalled.

11 Claims, 18 Drawing Sheets

1 pixel interva

PRINT TIMING SIGNAL PTS
Medium dot
Small dot
Large dot

COMMON DRIVE SIGNAL COM
W1
W2
W3

SMALL DOT MASK SIGNAL MSK

SMALL DOT DRIVE SIGNAL
W2

MEDIUM DOT MASK SIGNAL MSK

MEDIUM DOT DRIVE SIGNAL
W1

LARGE DOT MASK SIGNAL MSK

LARGE DOT DRIVE SIGNAL
W3

Transfer of drive waveform data from printer chassis to carriage (1)
Fig.11(A) SCLK
Fig.11(B) FLG "0"
Fig.11(C) DATA
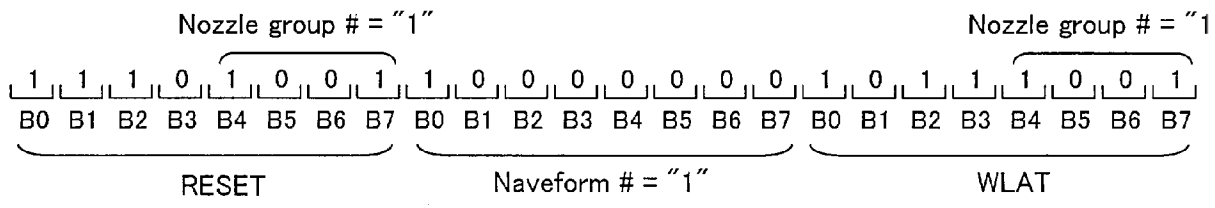
Fig.11(D) Data structure (during drive waveform data transmission)
| B0 | B1 | B2 | B3 | B4 | B5 | B6 | B7 |
|---|---|---|---|---|---|---|---|
| DLAT | WLAT | R/W | RESET | nozzle group # (1 −6) | | | |
RESET: Initiate transmission
DLAT: Data latching signal
R/W: Transmit (W)/receive (R) instruction
WLAT: Waveform selection latching signal Transfer of drive waveform data from printer chassis to carriage (2)
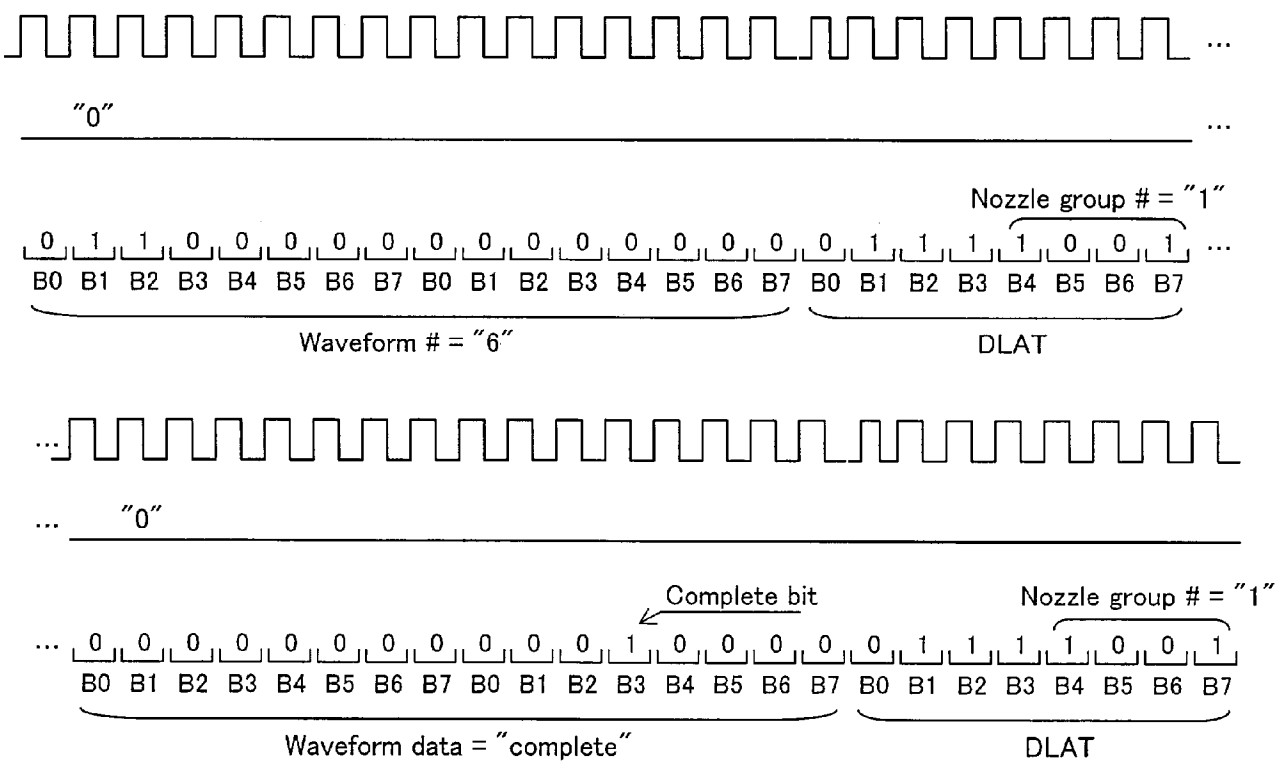

Transfer of print signal from printer chassis to carriage (2)

Fig.13(A)

SCLK

Fig.13(B)

FLG

"0" "1"

Fig.13(C)

DATA

Nozzle group designation = "1" Upper bit data (180 bits) Lower bit data (180 bits) Waveform # (32 bits)

0 0 0 0 0 0 0 1 0 0 1 0 0 0 0 0 1 0 ··· 1 1 0 1 ··· 0 1 1 ··· 0

B0 B1 B2 B3 B4 B5 B6 B7 B0 B1 B2 B3 B4 B5 B6 B7

PTS print signal SI

Fig.13(D)

Data structure (during print signal transmission)

PTS

| B0 | B1 | B2 | B3 | B4 | B5 | B6 | B7 |
|---|---|---|---|---|---|---|---|
| 0 | 0 | 0 | 0 | 0 | 0 | 0 | 1 |

Nozzle group designating flag

| B0 | B1 | B2 | B3 | B4 | B5 | B6 | B7 |
|---|---|---|---|---|---|---|---|
| 0 | 0 | 1/0 | 1/0 | 1/0 | 1/0 | 1/0 | 1/0 |
| | | ↑ | ↑ | ↑ | ↑ | ↑ | ↑ |
| | | Nozzle group : 60a | 60b | 60c | 60d | 60e | 60f |

Timing of PTS pulses and ink ejection on carriage
Pixel 1
Pixel 2
Pixel 3
Pixel 4
PTS
SI

DATA

K nozzle group
PTS pulse

K nozzle
Mask signal MSK

K nozzle
Drive signal
Small dot
Medium dot
Large dot

MULTI-PRINT HEAD PRINTING DEVICE

BACKGROUND OF THE INVENTION

1. Field of the Invention

This invention relates to an inkjet printing device having a plurality of print heads.

2. Description of the Related Art

In recent years, so-called inkjet printers have gained widespread acceptance as computer output devices. More recently, there have been proposed printers that employ a number of print heads for rapid printing of printed materials on large format paper such as A1 or A0 size.

However, printing devices equipped with multiple print heads have a problem in that in the event of malfunction of some of the print heads or of a constituent element thereof such as the drive control circuit, it can be very difficult to fix the malfunction. Another problem with multiple print heads is how to transmit signals among the drive circuits of the several print heads.

SUMMARY OF THE INVENTION

An object of the present invention is to provide a technique for use in a printing device whose carriage has plurality of print heads mounted thereon, whereby malfunction of constituent elements associated with print heads can be easily resolved.

In order to attain at least part the above and other related objects of the present invention, there is provided a printing device for effecting printing by ejecting ink from print head. The printing device comprises a plurality of head unit mountable positions on which a plurality of head units are mountable. Each head unit includes a predetermined number of print heads equal to one or greater, and a plurality of drive controllers for driving the predetermined number of print heads. Each head unit is individually installed and uninstalled on the printing device.

In one embodiment, a plurality of mountable positions for data processors each transferring data to a corresponding one of the drive controllers are also prepared in the printing device. Each data processor and each corresponding drive controller are interconnected by a flexible cable that includes a clock signal line for transmitting a clock signal, a flag signal line for transmitting a flag signal, and a serial data line for transferring serial data.

The present invention may be reduced to practice in various embodiments, such as, for example, a printing method and printing device; a print control method and print control device; a computer program for realizing any of the aforementioned methods and devices; a recording medium having recorded thereon such a computer program; and a data signal embodied in a carrier wave, including such a computer program.

These and other objects, features, aspects, and advantages of the present invention will become more apparent from the following detailed description of the preferred embodiments with the accompanying drawings.

BRIEF DESCRIPTION OF THE DRAWINGS

FIGS. 11(A)-11(D) show a method of transfer of drive waveform data from printer chassis to carriage.

FIGS. 12(A)-12(F) are timing charts showing a method of transfer of drive waveform data from printer chassis to carriage.

FIGS. 13(A)-13(D) show a print signal transfer method from the printer chassis to the carriage.

DESCRIPTION OF THE PREFERRED EMBODIMENT

Embodiments of the present invention shall be described hereinbelow through examples given in the following order.

A. Overall arrangement of the device;

B. Arrangement and operation of bidirectional communication;

C. Communication of ink quantity information;

D. Variations

Figure 1:
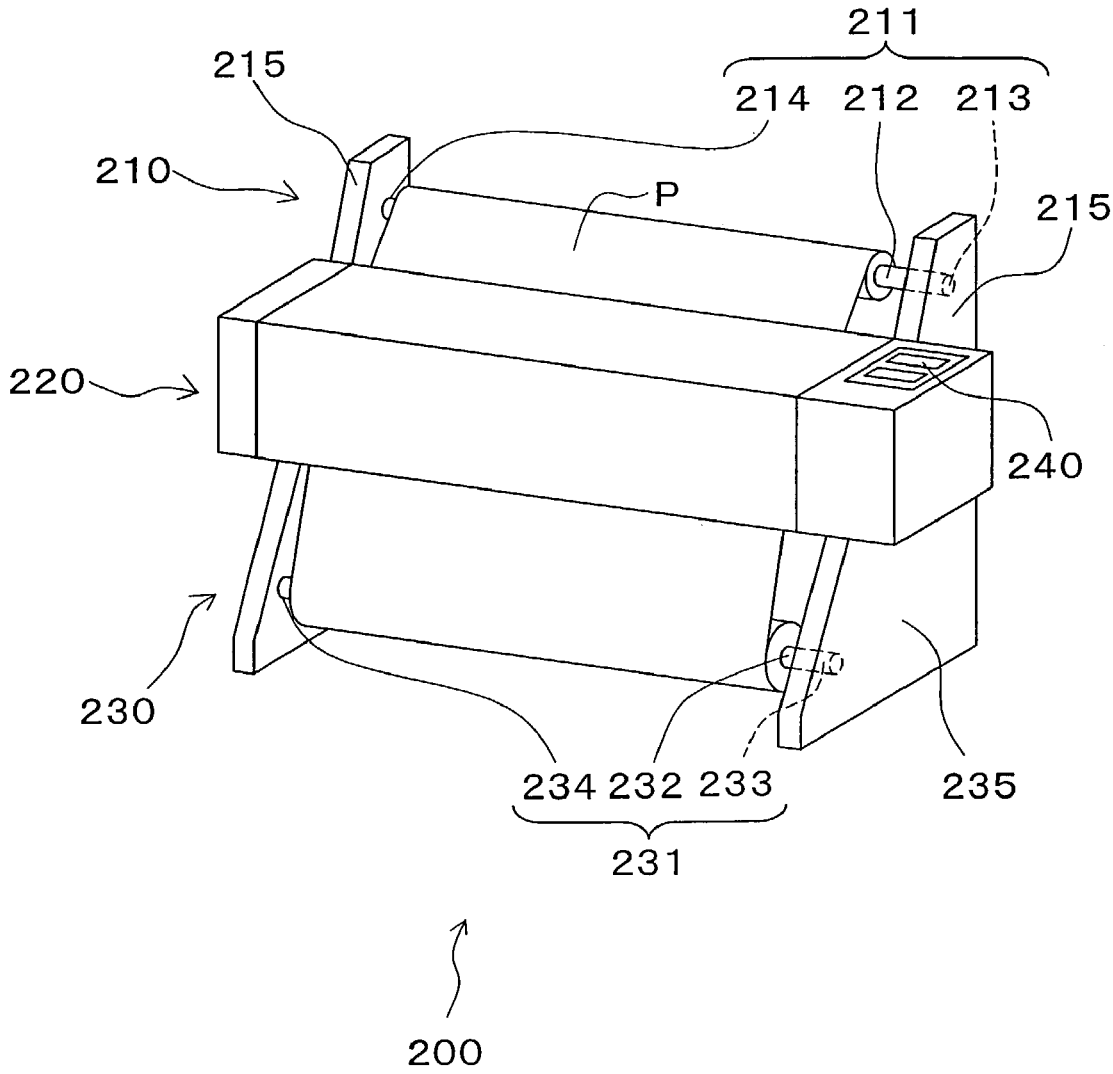
FIG. 1 is a perspective view showing the general arrangement of a printer 200 embodying the invention.

A. Overall Arrangement of the Device:

FIG. 1 is a perspective view showing the general arrangement of a printer 200 in an embodiment of the invention. Printer 200 is compatible with relatively large format printer paper P, for example, JIS standard A0 or B0 sheet paper or roll paper. Printer paper P is fed by a paper feed section 210 to a printing section 220. Printing section 220 performs printing by ejecting ink onto printer paper P. Printer paper P, once printed in printing section 220, is then discharged through a paper discharge section 230.

Paper feed section 210 comprises a roll paper holder 211 in which a roll of printer paper P can be installed. Roll paper holder 211 comprises a spindle 212 for holding the roll of paper, and a first spindle bearing 213 and second spindle bearing 214 across which spindle 212 can be detachably installed. The two spindle bearings 213, 214 are disposed on two support posts 215 provided in the upper portion of printer 200. Once a roll of paper has been installed in the center of spindle 212, it is installed with its two ends mounted in first spindle bearing 213 and second spindle bearing 214.

Paper discharge section 230 comprises a wind off holder 231 that can wind off paper from the roll. Wind off holder 231 comprises a wind off spindle 232 for winding roll paper printed in the printing section 220, and a first spindle bearing 233 and second spindle bearing 234 across which spindle 232 can be detachably installed. The two spindle bearings 233, 234 are disposed on two support posts 235 provided in the lower portion of printer 200. Spindle 232 is installed in first spindle bearing 233 and second spindle bearing 234 so as to be rotatable by drive means, not shown. In another arrangement, spindle 212 can also be turned by drive means to wind up printer paper P. As will be described hereinbelow, paper feed means such as paper discharge rollers may be provided in printing section 220, the paper feed means being driven in order to discharge printer paper P.

On the upper face of printing section 220 is disposed an input/output section 240 containing keys for entering print mode etc., and a display section.

Figure 2:
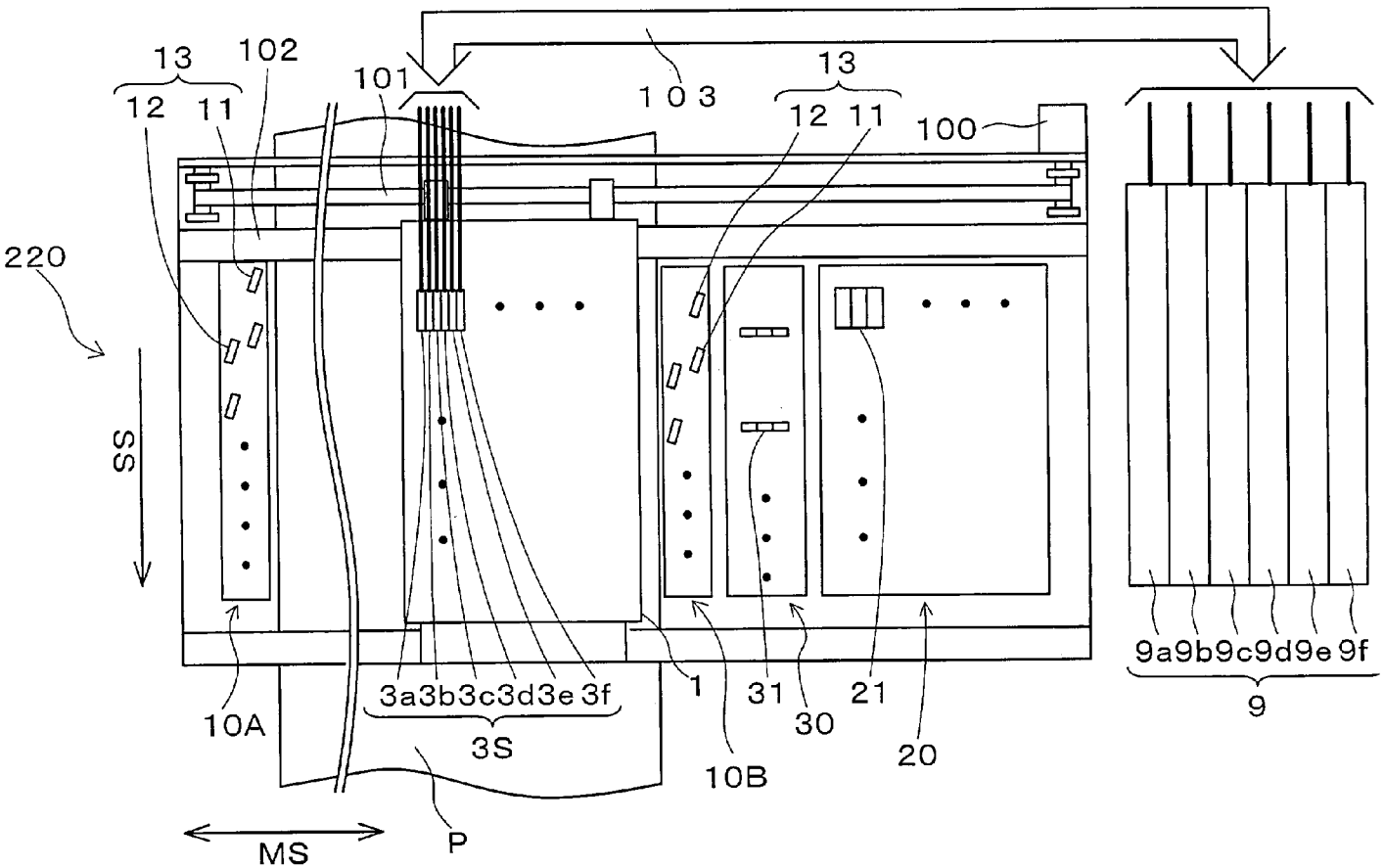
FIG. 2 illustrates the arrangement of printing section 220

FIG. 2 illustrates the arrangement of printing section 220. Printing section 220 has a carriage 1 on which are installed a plurality of print head units (described later). A plurality of sub-tank sets 3S for temporarily holding ink for use by the print heads are mounted on carriage 1. Carriage 1 is linked to a drive belt 101 that is driven by a carriage motor 100, enabling it to move along the main scanning direction MS guided by a main scan guide member 102. At the two edges of printer paper P in the range of movement of carriage 1 in the main scanning direction are disposed a first check section 10A and a second check section 10B for performing a nozzle ejection check. To the side of second check section 10B are disposed a wiper section 30 for wiping nozzles, a cap section 20 for sealing and cleaning nozzle groups, and main tanks 9 for supplying ink to sub-tank sets 3S.

To perform printing, carriage 1 is moved in the main scanning direction while ejecting ink from the nozzles onto printer paper P to effect printing. When performing a nozzle ejection check, carriage 1 moves to a location of the first check section 10A or second check section 10B, where the nozzle ejection check is performed. When wiping nozzles, carriage 1 moves to a location of the wiper section 30, where wiping of nozzles is performed. To perform cleaning with the cap 21, carriage 1 moves to a location of the cap 21, where cleaning of nozzles is performed.

Sub-tank sets 3S and main tanks 9 are connected by an ink feed path 103. In this example, one sub-tank set 3S includes six sub-tanks 3*a*-3*f* for six kinds of ink, namely, black K, cyan C, light cyan LC, magenta M, light magenta LM, and yellow Y. These six sub-tanks 3*a*-3*f* are connected to six corresponding main tanks 9*a*-9*f*. It should be noted that the number of inks used is not limited to six: four kinds of ink (e.g. black K, cyan C, magenta M, and yellow Y) or seven kinds of ink (e.g. black K, light black LK, cyan C, light cyan LC, magenta M, light magenta LM, and yellow Y) could be used instead.

Figure 3:
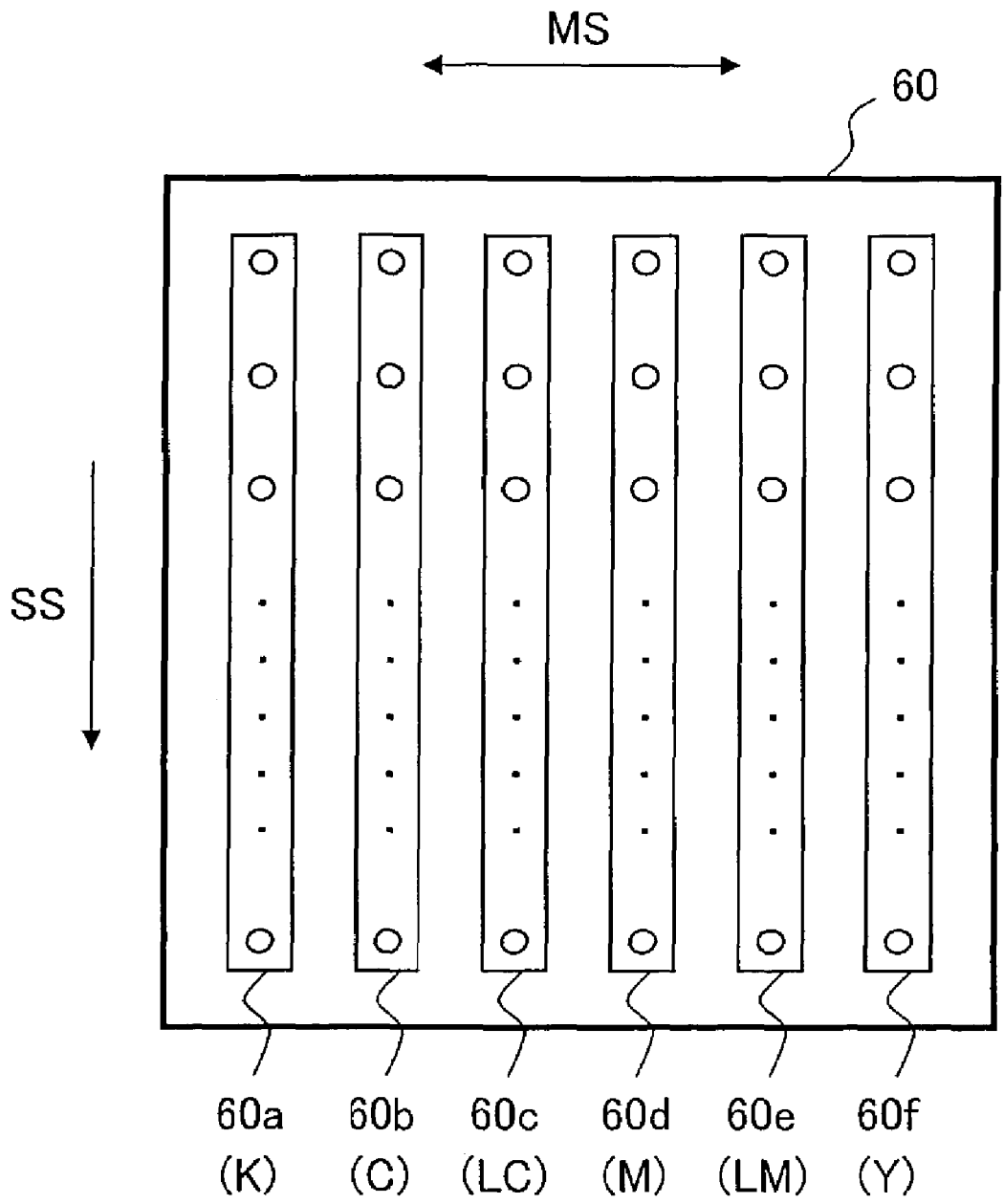
FIG. 3 illustrates an arrangement of nozzles on the lower face of one print head 60.

FIG. 3 is an illustration showing an arrangement of nozzles on the lower face of one print head 60. Print head 60 has six nozzle groups 60*a*-60*f*. In this example, a different ink is assigned to each nozzle group, but a particular ink could be ejected from multiple nozzle groups instead.

A light emitter 11 and a light receiver 12 make up a check unit 13 for checking whether ink is being ejected normally from each nozzle (hereinafter termed "ejection check"). First check section 10A and second check section 10B are each provided with multiple sets of such check units 13. First check section 10A and second check section 10B are optional and may be omitted.

Figure 4:
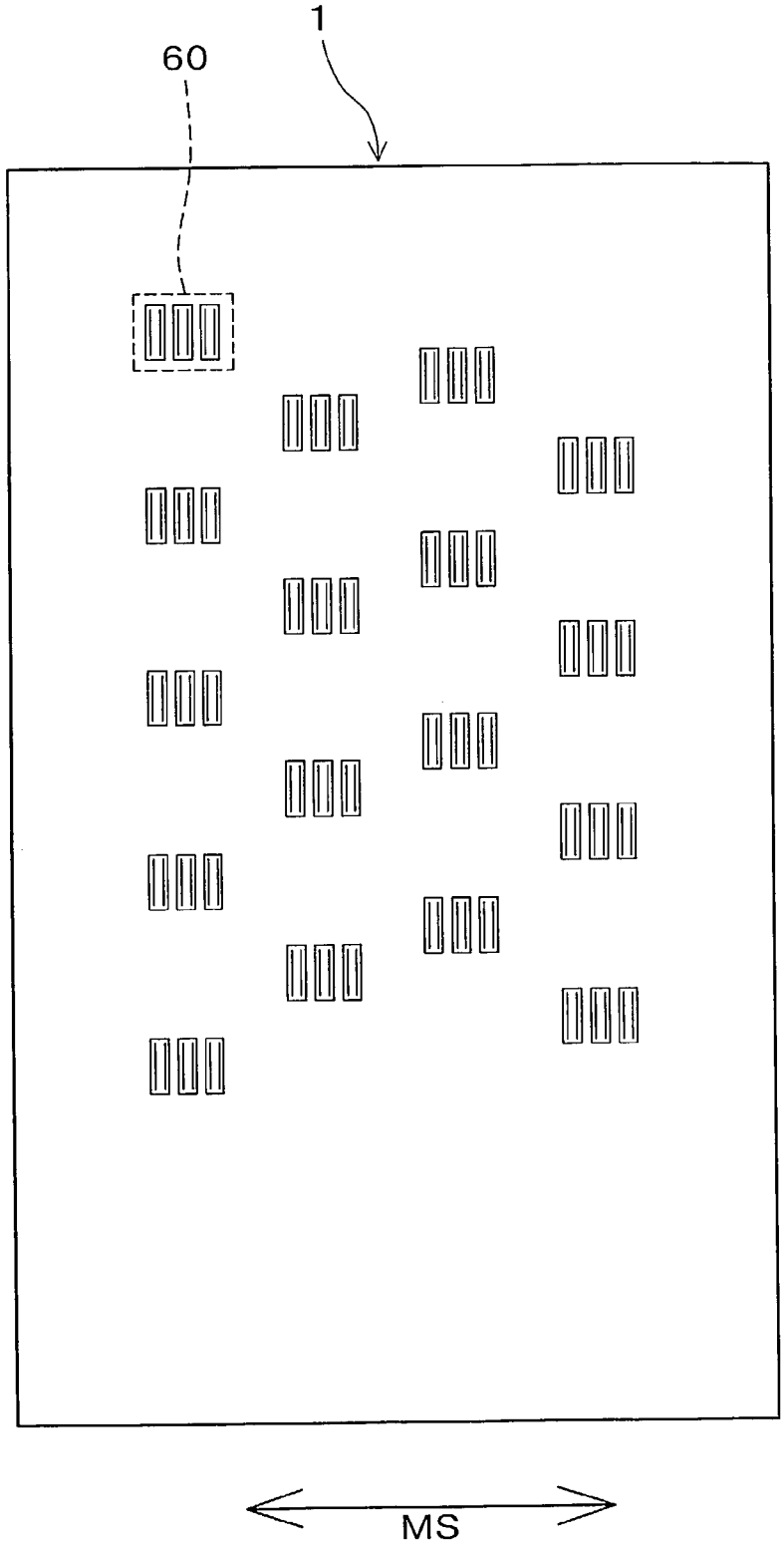
FIG. 4 is a simplified illustration showing a carriage 1.

FIG. 4 is a simplified illustration showing a carriage 1. In this example, a plurality of print heads 60 are arranged on carriage 1. As a result, it is possible to print a relatively wide area in the sub scanning direction all at one time, and printing can be performed rapidly even where relatively large format printer paper is used. Each print head 60 is independently replaceable.

Figure 5:
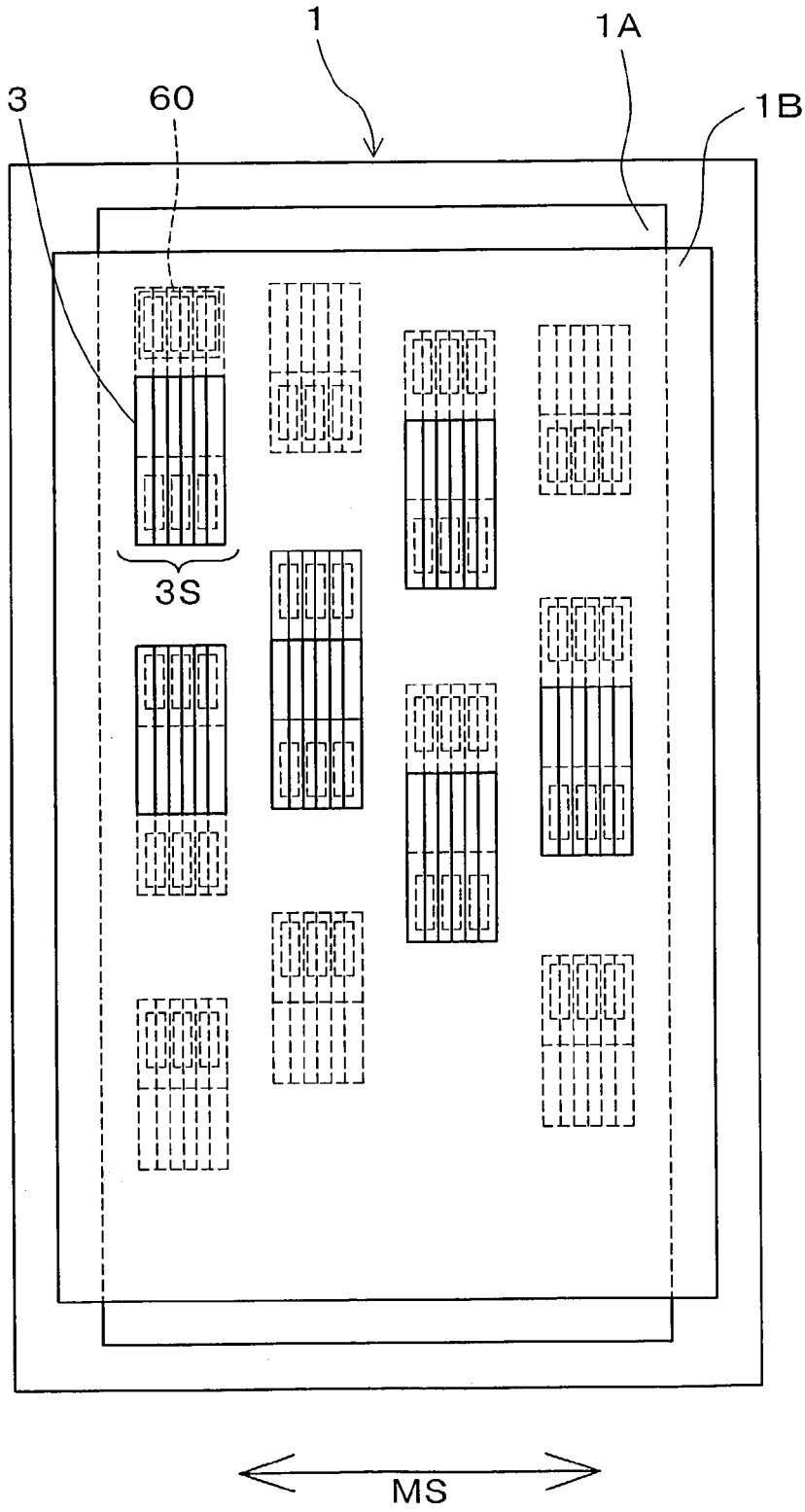
FIG. 5 is a simplified illustration showing sub-tanks 3 installed on a carriage 1.

FIG. 5 is a simplified illustration showing sub-tanks 3 installed on a carriage 1. One sub tank set 3S for each print head 60 is arranged on carriage 1. In this example, two-dimensional arrangement of all sub-tank sets 3S on carriage 1 is not possible, so the sub-tank sets 3S are mounted on either of two-level sub-tank plates 1A, 1B provided on carriage 1. The number of plates is not limited to two: depending on the number of sub-tanks 3, a single level or three or more levels could be provided.

Figure 6:
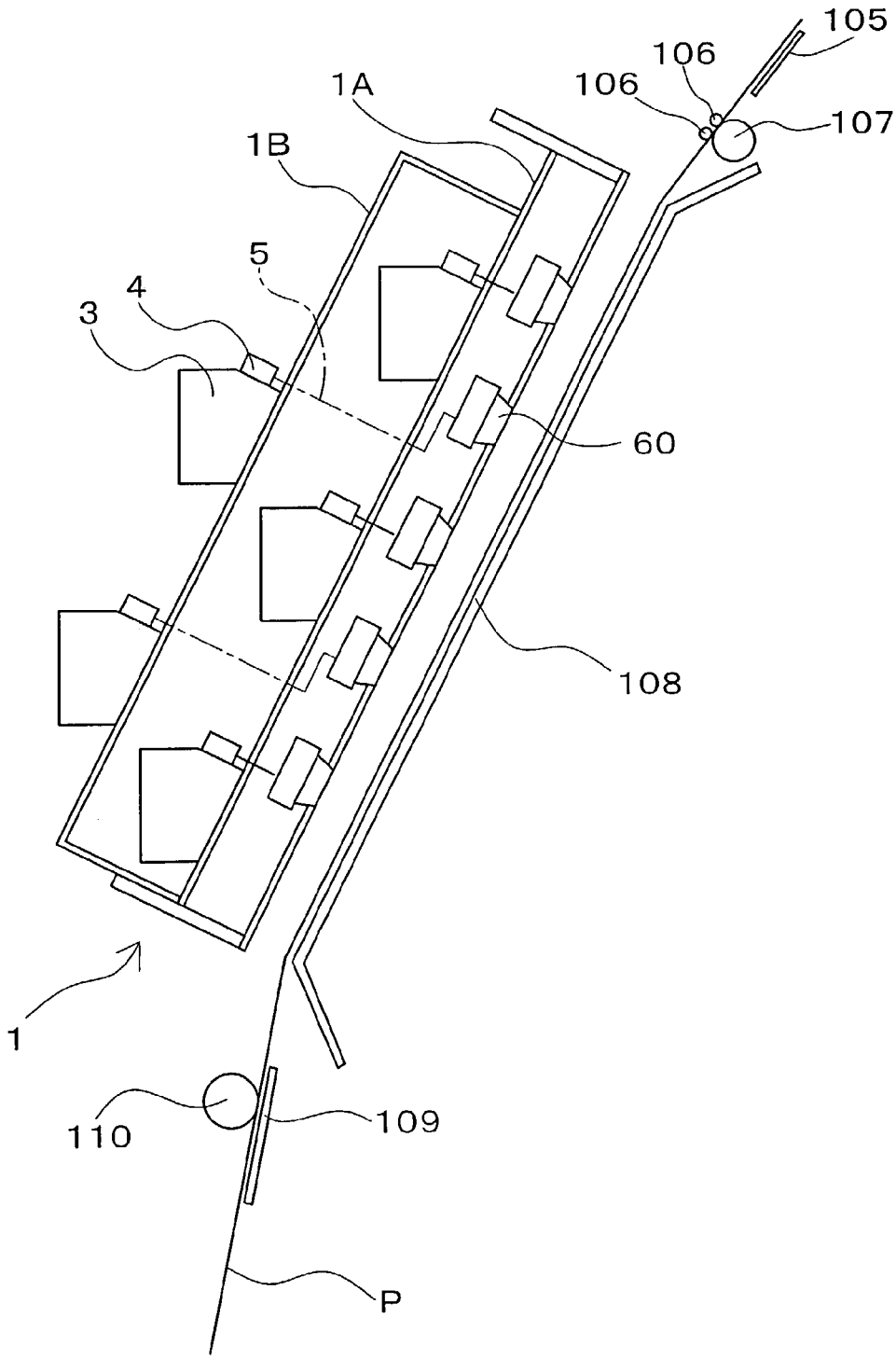
FIG. 6 is a partly sectional view of a printing section 220 including a carriage 1.

FIG. 6 is a partly sectional view of a printing section 220 including a carriage 1. Printer paper P supplied from paper feed section 210 (FIG. 1) is transported along a feed path going from the upper rear portion of printer 200 (upper right in FIG. 6) to the lower front portion (lower left in FIG. 6), where it is discharged to the paper discharge section 230.

On the printer paper feed path are disposed, in order from the paper feed section 210 end, a paper feed guide 105, paper feed rollers 106, a follower roller 107 arranged juxtaposed to paper feed rollers 106, a sloping print stage 108, a carriage 1 arranged juxtaposed to print stage 108, a paper discharge guide 109, and a paper discharge roller 110 arranged juxtaposed to paper discharge guide 109.

Paper feed guide 105, print stage 108, and paper discharge guide 109 are provided with flat surfaces functioning as printer paper feed surfaces. Since the printer paper P is therefore transported along a flat path, wrinkling of the printer paper P and distortion of printed images can be avoided even when relatively large format paper is used.

The two-level sub-tank plates 1A, 1B on carriage 1 each have a plurality of sub-tanks 3 mounted thereon. Each sub-tank 3 has a valve 4. Print heads 60 and sub-tanks 3 are connected by ink supply paths 5 via valves 4. In this example, since each single print head 60 has six nozzle groups, six sub-tanks 3*a*-3*f* (FIG. 2) are connected to each single print head 60. By appropriately opening and closing valves 4 for the six nozzle groups of a single print head 60, ink can be supplied thereto on an individual basis.

Placement locations for the sub-tanks 3 is such that the relationship of sub-tank 3 height and corresponding print head 60 height is substantially the same regardless of print head 60 location. By so doing, difference in hydraulic head between sub-tanks 3 and print heads 60 can be minimized. Difference in ink ejection quantity due to difference in hydraulic head can therefore be minimized as well, to give consistent image quality. Placement locations for the sub-tanks 3 may be such as to enable fine adjustment. Where there is some deviation in ink ejection quantity among print heads, hydraulic head differential can be adjusted by adjusting sub-tank placement locations to enable adjustment of ink ejection quantity.

Figure 7:
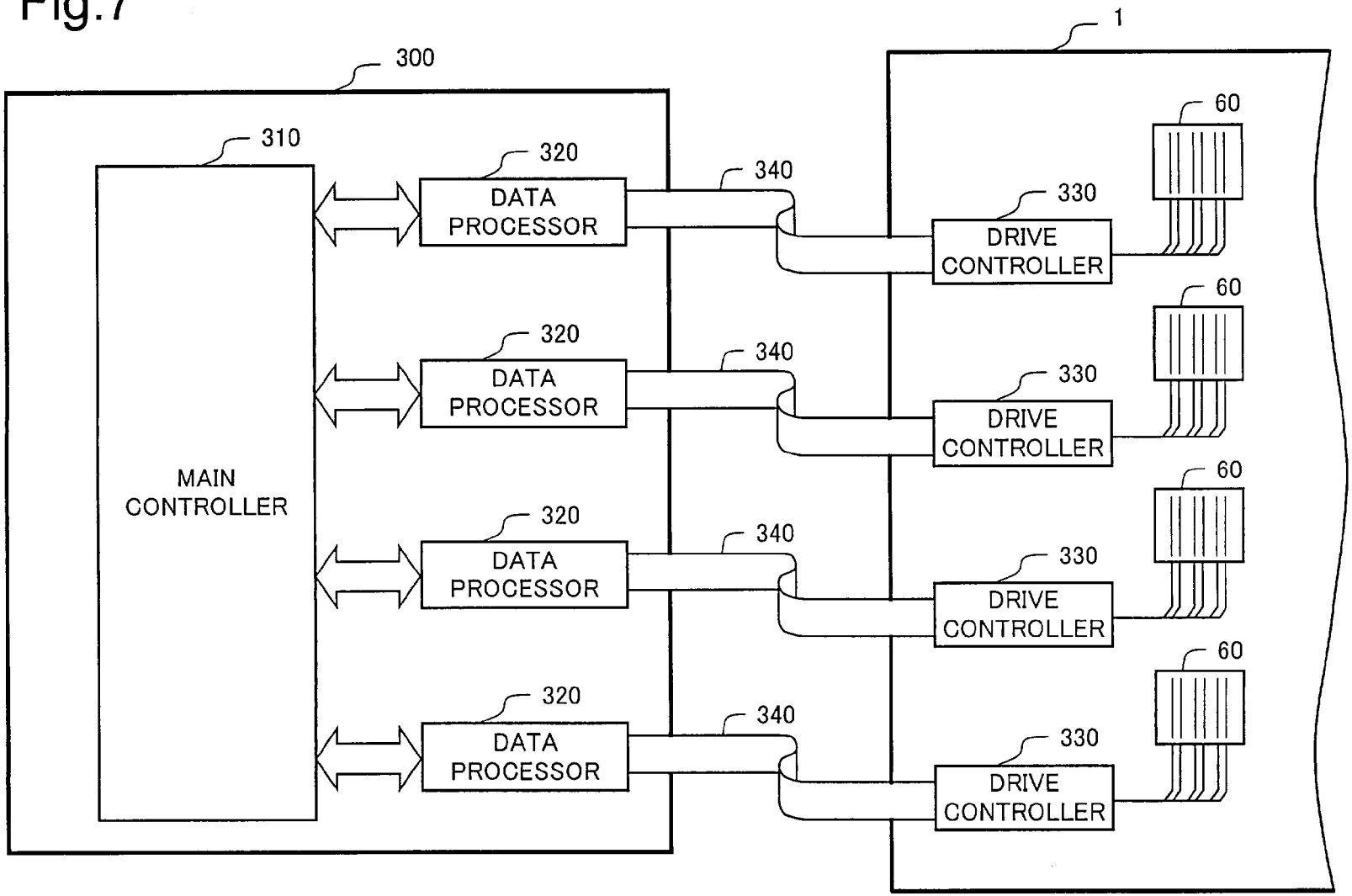
FIG. 7 is a block diagram showing a circuit arrangement relating to bidirectional communication between a printer chassis 300 and a carriage 1.

B. Arrangement and Operation of Bidirectional Communication:

FIG. 7 is a block diagram showing a circuit arrangement relating to bidirectional communication between a printer chassis 300 and a carriage 1. "Printer chassis" herein refers to those components of printer 200 that do not move from their installed location.

Printer chassis 300 comprises a single main controller 310, and a plurality of data processors 320 associated with the plurality of print heads 60 on carriage 1. On carriage 1 are disposed a plurality of drive controllers 330 associated with the plurality of print heads 60. A data processor 320 and its associated drive controller 330 are connected by a single flexible cable 340. In this example, as shown in FIG. 4, seventeen print heads 60 are provided, so seventeen flexible cables 340 are arranged between the printer chassis 300 and the carriage 1. Twisted pair cables or shielded cables could be used in place of flexible cables 340.

Main controller 310 is a control circuit for controlling the entire printer. Data processors 320 are control circuits for performing bidirectional communication between printer chassis 300 and carriage 1. Drive controllers 330 are control circuits for performing bidirectional communication with data processors 320, as well as executing control to eject ink from print heads 60.

In this example, a single print head 60 and a single drive controller 330 constitute a single head unit, with the head unit designed such that any individual head unit can be installed and uninstalled on the carriage. Carriage 1 includes a plurality of head unit mountable positions on which a single head unit is mountable. A single head unit and a single data processor 320 together constitute a single circuit set, with the circuit set designed such that any individual set can be installed and uninstalled on the printer. Printer chassis 300 includes a plurality of data processor mountable positions on which a single data processor 320 is mountable. This configuration has the advantage that in the event of a malfunction of a certain print head 60, drive controller 330, or data processor 320, for example, there is no need to repair all circuit sets on the carriage, it being sufficient to simply replace the malfunctioning circuit set or the malfunctioning head unit. The number of print heads 60 in a single head unit can be any predetermined number equal to one or greater. For example, a single head unit could be composed of three print heads 60, and one drive controller 330.

In preferred practice, head units will be designed such that a head unit can be selected from among a plurality of types of head units differing at least partially in their design. Similarly, circuit sets will be designed such that a circuit set can be selected from among a plurality of types of circuit sets differing at least partially in their design. For example, a plurality of types of head units differing in the number of print heads 60 making up the head unit may be selected. This enables the user to easily configure the printing device to his or her preference.

Figure 8:
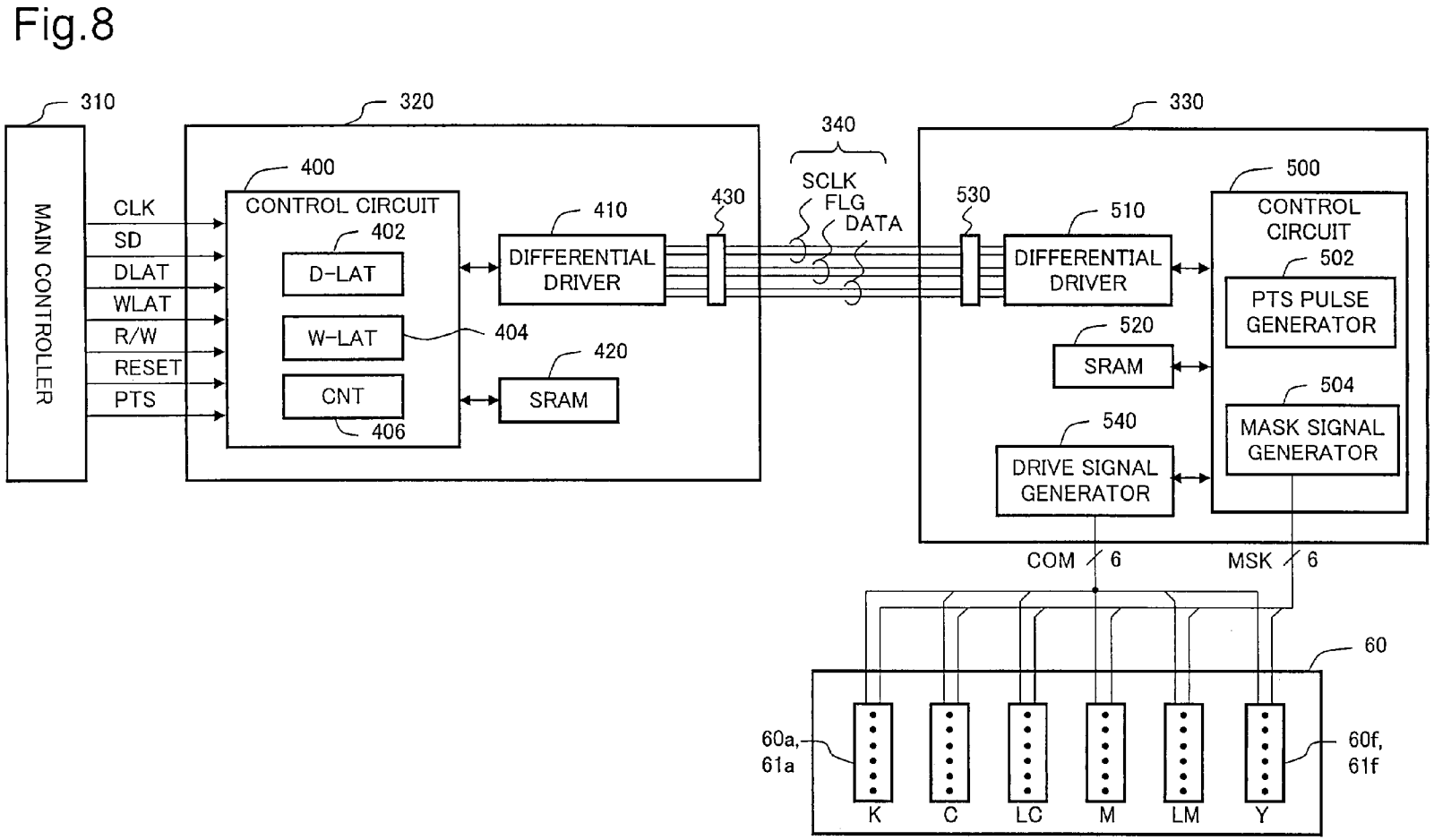
FIG. 8 is a block diagram showing the internal arrangement of a data processor 320 and drive controller 330.

FIG. 8 is a block diagram showing the internal configuration of a data processor 320 and drive controller 330. Data processor 320 comprises a control circuit 400, a differential driver 410, SRAM 420, and an interface 430. Control circuit 400 is configured as a gate array, and contains a data latch 402, a waveform selection latch 404, and a counter 406.

Drive controller 330 comprises a control circuit 500, a differential driver 510, SRAM 520, an interface 530, and a drive signal generating circuit 540. Control circuit 500 has a PTS pulse generating circuit 502, and a mask signal generating circuit 504. Control circuit 500 also has a latch and counter similar to those on the chassis-side control circuit 400, but these are not shown.

Control circuit 400 and differential driver 410 constitute a transceiving section (data processor) on the chassis side. Control circuit 500 and differential driver 510 constitute a transceiving section (drive controller) on the carriage side. The PTS pulse generating circuit 502, mask signal generating circuit 504, and drive signal generating circuit 540 together constitute a head drive controller.

Flexible cable 340 connecting interfaces 430, 530 has a clock signal line pair for transmitting a clock signal SCLK, a flag signal line pair for transmitting a flag signal FLG, and a serial data line pair for transferring serial data DATA. Herein, symbols indicating signals and symbols indicating signal lines (or signal line pairs) are used interchangeably.

In this example, flexible cable 340 includes only a ground line (not shown) in addition to the three types of signal line pairs SCLK, FLG, DATA mentioned above. Typically, power lines such as a ground line are not signal lines for transmitting changes in signal level. That is, as signal lines for transmitting changes in signal level, the flexible cable 340 herein includes only three types of signal line pairs SCLK, FLG, DATA, so the size of the flexible cable 340 per se can be kept small. As noted, in the printer of the present example, seventeen flexible cables 340 are provided for the seventeen print heads 60, so if the flexible cables 340 were large, a sizeable space would be needed to accommodate the signal lines between the chassis 300 and the carriage 1. In this example, the types of signal lines making up the flexible cables 340 are kept to a minimum, thus reducing the space needed for routing the cables, resulting in a decrease in the size of the printer per se.

The nozzle groups 60*a*-60*f* of print head 60 are provided with driver circuits 61*a*-61*f* for driving the drive elements of the nozzles in response to a common drive signal COM provided by drive signal generating circuit 540 and a mask signal MSK provided by mask signal generating circuit 504. The functions of these circuits will be discussed later. Alternatively, mask signal generating circuit 504 may be provided in the driver circuits 61*a*-61*f* for each nozzle group, rather than in control circuit 500.

Figure 9:
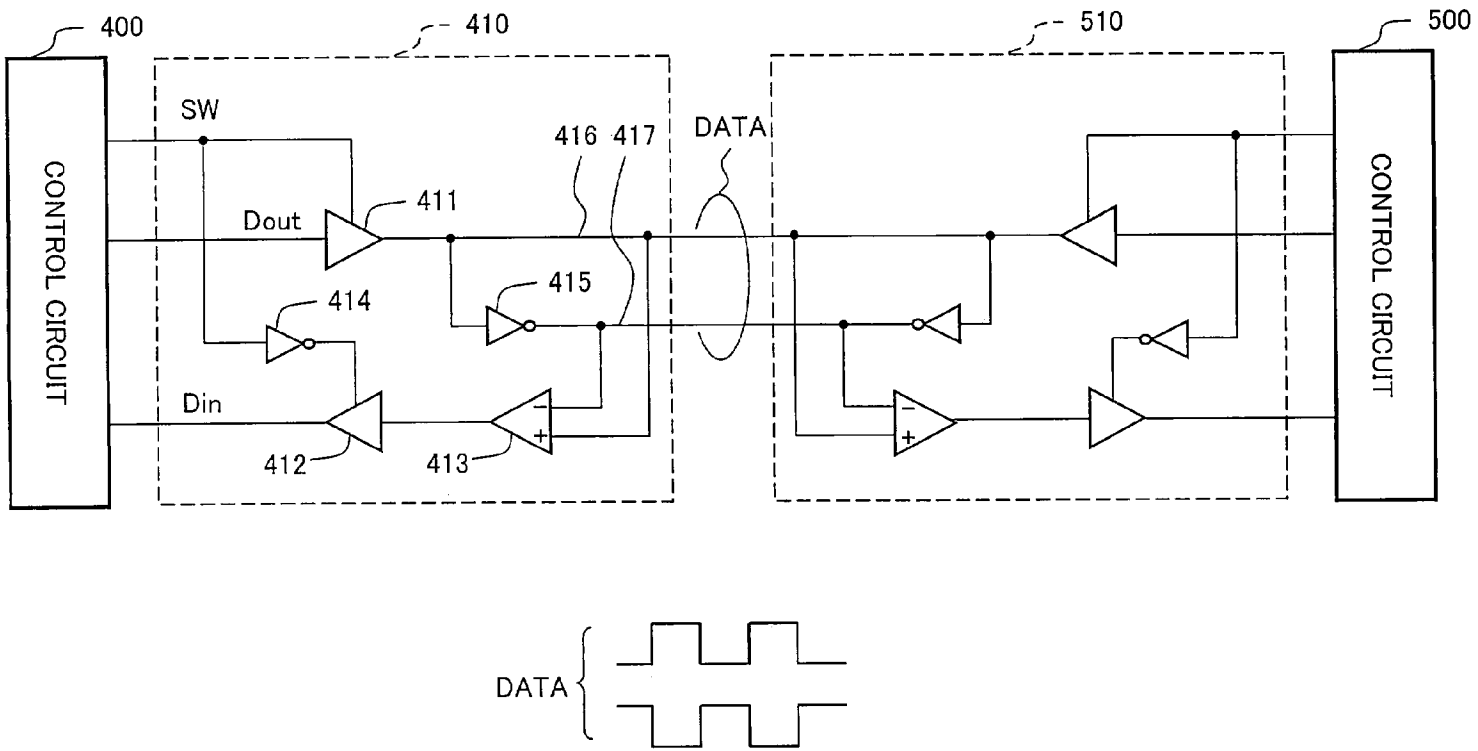
FIG. 9 is a block diagram showing the internal arrangement of differential drivers 410, 510.

FIG. 9 is a block diagram showing the internal arrangement of differential drivers 410, 510. The chassis-side differential driver 410 has first and second 3-state buffers 411, 412, a differential amplifier 413, and first and second inverters (NOT circuits) 414, 415. The carriage-side differential driver 510 has a similar arrangement.

The first and second 3-state buffers 411, 412 are assigned for transmitting and receiving signals, respectively. A switching signal SW is presented by control circuit 400 to the control terminal of the first 3-state buffer 411, and a signal resulting from inversion of switching signal SW by inverter 414 is presented to the control terminal of the second 3-state buffer 412. Thus, differential driver 410 is set to either transmit mode or receive mode, depending on the level of the switching signal SW.

Data Dout transmitted from the chassis-side control circuit 400 to the carriage-side control circuit 500 is initially input to the input terminal of the first 3-state buffer 411. The output of the first 3-state buffer 411 and the inverted output resulting from inversion thereof by inverter 415 are transmitted to the carriage-side differential driver 510 through two signal lines 416, 417. These two signal lines 416, 417 constitute a serial data signal line pair DATA for data transmission. The two input terminals of differential amplifier 413 are connected to this serial data signal line pair DATA. The output of the differential amplifier 413 is presented to the second 3-state buffer 412. Data Din transmitted from the carriage-side control circuit 500 to the chassis-side control circuit 400 is supplied to control circuit 400 via the second 3-state buffer 412.

As shown at bottom in FIG. 9, the data signals transmitted through serial data signal line pair DATA are signals whose waveforms are mutually inverted, and are transmitted in so-called differential format. Through transmission of signals in differential format in this manner it is possible to reduce transmission error while transmitting at higher speeds. Differential driver 410 also includes circuit elements for transmitting a clock signal CLK and a flag signal FLG (FIG. 8), but these have been omitted from FIG. 9 for convenience in illustration.

The following kinds of data and signals are transmitted from the chassis side to the carriage side, via flexible cables 340.

(i) Drive signal waveform data representing a drive signal waveform for driving print heads 60.

(ii) A print timing signal for notifying of the timing of ink ejection.

(iii) A print signal indicating ink ejection status from each nozzle.

Figures 10A, 10B, 10C, 10D, 10E, 10F, 10G, 10H:
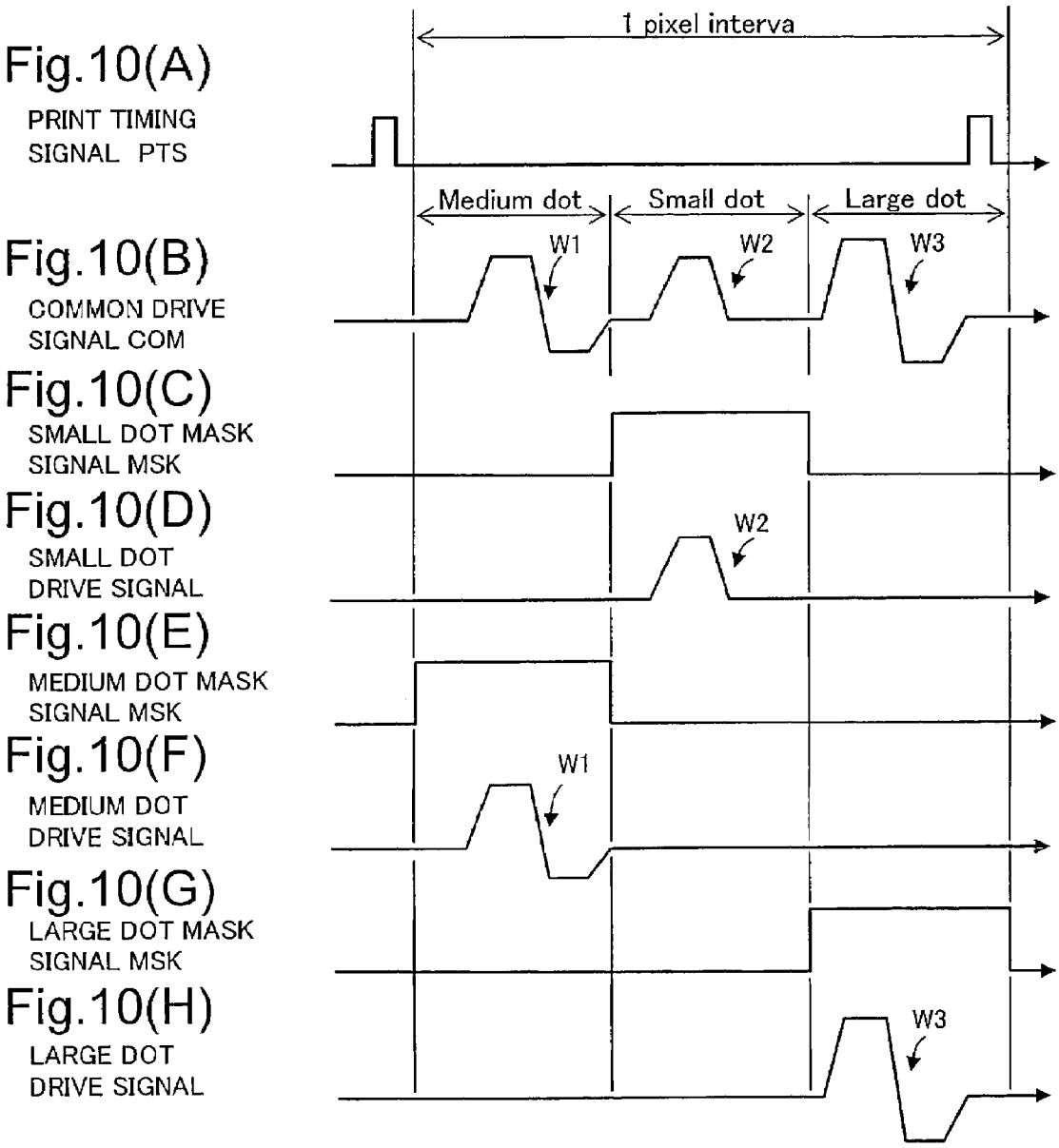
FIGS. 10(A)-10(H) are timing charts showing signals employed to eject ink.

FIGS. 10(A)-10(H) are timing charts showing the signals employed to control ink ejection. As shown in FIG. 10(A), print timing signal PTS is a signal indicating timing for ejection of ink for a single pixel from each nozzle, and is generated on a per-pixel basis. However, it should be noted that a single print timing signal PTS is typically used in common by part of or the entirety of the nozzles within a single nozzle group. In this example, since a single print head 60 (FIG. 3) has six nozzle groups 60*a*-60*f*, six print timing signal PTS are generated for a single print head 60.

The common drive signal COM shown in FIG. 10(B) is a signal in which three pulses W1, W2, W3 having mutually different waveforms are generated in three sub-intervals within a single pixel interval. This type of common drive signal COM is produced by D/A conversion of drive signal waveform data stored in SRAM 520 by the drive signal generating circuit 540 on the carriage (FIG. 8). Drive signal waveform data represent the common drive signal COM waveform for a single pixel, and is provided beforehand by the main controller 310 of the printer chassis. In this example, drive signal generating circuit 540 generates six types of common drive signal COM for supply to the six nozzle groups 60*a*-60*f*. SRAM 520 therefore stores six or more types of waveform data. The reason that the signal is termed a "common drive signal" is that it is employed in common for several nozzles of the same nozzle group.

As shown in FIGS. 10(C) and 10(D), where a small dot is to be recorded, unnecessary pulses W1, W3 are masked in response to a mask signal MSK so that only the second pulse W2 remains. The waveform of the mask signal MSK is produced by the mask signal generating circuit 504 (FIG. 8) in response to a print signal SI supplied from the chassis side. Similarly, where a medium dot is to be recorded, unnecessary pulses W2, W3 are masked so that only the first pulse W1 remains (FIGS. 10(E), 10(F)); and where a large dot is to be recorded, unnecessary pulses W1, W2 are masked so that only the third pulse W3 remains (FIGS. 10(G), 10(H)). In this way, by masking part of the common drive signal COM with reference to a print signal SI that indicates dot recording status for each pixel, dots of any of three different sizes can be selectively recorded at each pixel position. The common drive signal COM may take any other waveforms.

When transmitting a print timing signal PTS, print signal SI, and drive waveform data, signals such as the following are initially provided by the main controller 310 to the data processor 320.

(1) Clock signal CLK: synchronizing clock used when transmitting signals from main controller 310 to data processor 320.

(2) Serial data signal SD: signal representing data; held in control circuit 400

(3) Data latching signal DLAT: signal indicating timing for data latch 402 to hold print data provided as a serial signal, waveform data, etc.

(4) Waveform selection latching signal WLAT: signal indicating timing for waveform selection latch 404 to hold waveform number provided as a serial signal.

(5) Transmit (W)/receive (R) instruction signal R/W: signal indicating whether data processor 320 is operating in transmit mode or receive mode.

(6) Reset signal RESET: signal for resetting various circuit elements in control circuit 400

(7) Print timing signal PTS: signal for notifying timing of ink ejection 6;3] When data processor 320 is provided by main controller 310 with drive signal waveform data, print timing signals PTS, print signals etc. by means of the above signals, data processor 320 then temporarily stores the data in latches 402, 404 and SRAM 420 in control circuit 400. The stored data is then promptly transmitted to drive controller 330.

FIGS. 11(A)-11(D) and 12(A)-12(F) are timing charts showing the transfer of drive waveform data from chassis-side circuitry to carriage-side circuitry. FIGS. 11(A), 11(B) and 11(C) respectively show the three types of signals SCLK, FLG, and DATA transmitted via flexible cable 340 (FIG. 8). Flag signal FLG is set to 0 level (L level) during transfer of drive waveform data. Data signal DATA is transmitted in units of one bit per cycle of the clock signal SCLK. In this example, as a general rule, a data signal DATA composed of 8 bits B0-B7 is transmitted as a single unit. Here, bit B0 denotes the least significant bit, and bit B7 denotes the most significant bit.

FIG. 11(D) shows the structure of data signal DATA when drive waveform data is transmitted. The lower four bits B0-B3 are used as flags to identify the content of data signal DATA. It should be noted that these bits B0-B3 are of active low polarity. Specifically the least significant bit B0 is 0 level (L level) only when the content of the data signal is a data latching signal DLAT. Bit B1 is 0 level only when the content of the data signal is a waveform selection latching signal WLAT. Bit B2 is 0 level only when the content of the data signal is a transmit/receive instruction signal R/W. Bit B3 is 0 level only when the content of the data signal is a reset signal RESET. Each of these four types of signals DLAT, WLAT, R/W, RESET is provided from main controller 310 (FIG. 8) to data processor 320.

The upper four bits B4-B7 of data signal DATA denote nozzle group number. In this example, since one print head 60 has six nozzle groups 60*a*-60*f*, values of 1 to 6 are used for nozzle group number.

When transferring drive waveform data, initially, 8-bit data representing a reset signal RESET is transferred to the carriage side as shown in FIG. 11(C). Of the lower four bits B0-B3 of this 8-bit data, only bit B3 is 0 level, indicating that it is a reset signal RESET; the other bits B0-B2 are 1 level. The upper four bits B4-B7 indicate nozzle group number. When the upper four bits B4-B7 indicate nozzle group number, for example, the most significant bit B7 is normally set to "1", with the other 3 bits B4-B6 being binary digits that indicate a nozzle group number from 1 to 6. In the 8-bit data representing a reset signal RESET shown in FIG. 11(C), the nozzle number is set to "1", indicating the first nozzle group 60*a* (FIG. 3). Alternatively, the 8-bit data representing a reset signal RESET may not include a nozzle number.

Transfer of 8-bit data representing a reset signal RESET is followed by transfer of 8-bit data representing a waveform number in binary digits. "Waveform number" herein refers to a number assigned to the waveform of a common drive signal COM (FIG. 10) for a single pixel. Since the printer in this example can use multiple types of common drive signals, waveform data for the common drive signals is stored together with their associated waveform numbers in SRAM 520 (FIG. 8). As will be described later, the main controller 310, when sending print data, also instructs the drive controller 330 which nozzle group employs which waveform data.

Transfer of 8-bit data indicating waveform number is followed by transfer of 8-bit data representing a waveform selection latching signal WLAT. When this waveform selection latching signal WLAT is received by the carriage-side control circuit 500, the waveform number is held by the latch (not shown) in control circuit 500, and a memory area for waveform data relating to the waveform number is secured in SRAM 520.

Next, as shown in FIGS. 12(A)-12(C), 16 bit (=8 bits×2) waveform data representing the signal level of the common drive signal in binary digits is transferred. Transfer of the 16-bit waveform data is followed by transfer of 8-bit data representing a data latching signal DLAT. The lower 4 bits B0-B3 of this 8-bit data indicate that the signal is a data latching signal DLAT (see FIG. 11(D)), and the upper four bits B4-B7 indicate nozzle group number. When the carriage-side control circuit 500 receives this data latching signal DLAT, it holds the waveform data in the latch (not shown) in control circuit 500, and then stores it in SRAM 520.

The 24-bit data composed of the 16-bit waveform data and 8-bit data latching signal DLAT is transferred repeatedly a number of times equal to waveform data number. Once transfer of all waveform data representing the waveform of a single common drive signal has been transferred, data indicating completion of waveform data is transferred, as shown in FIGS. 12(D)-12(F). In this example, waveform data in which the 12th lowest bit (second B3 bit) is set to 1 level and all the other bits to 0 level is transferred. When the carriage-side control circuit 500 receives this waveform data, it determines that transfer of waveform data has been completed.

The data transfer illustrated in FIGS. 11(A)-11(D) and 12(A)-12(F) is executed repeatedly until transfer of waveform data relating to all common drive signals used in printing has been completed. This transfer of waveform data is typically executed when the printer starts up. Optionally, waveform data may be transferred after printer startup as well. For example, print heads could be provided with temperature sensors, waveform data corrected by main controller 310 with reference to sensed temperature, and the corrected waveform data then transferred to drive controller 330. Waveform data could also be corrected with reference to remaining ink quantity.

FIGS. 13(A)-13(D) show a print signal transfer method from the printer chassis to the carriage. As shown in FIG. 13(C), when a print signal is transferred, 8-bit data indicating a print timing signal PTS is transferred first, followed by data indicating a print signal SI.

At the time of transfer of the print timing signal PTS, the flag signal FLG is set to 0 level (L level). As shown in FIG. 13(D), in the 8-bit data indicating the print timing signal PTS, the most significant bit B7 is 1 level, and the other bits B0-B6 are all set to 0 level. The flag signal FLG is set to 0 level at the time of transfer of the drive waveform data shown in FIGS. 11(A)-11(D) as well, but in this instance the lower 4 bits B0-B3 are not all 0 level; only one of them is 0 level. In contrast, at the time of transfer of the print timing signal PTS, all of the lower 4 bits B0-B3 are 0 level, by which it can be determined which signal is being transferred.

At the time of transfer of a print signal SI, the flag signal FLG is set to 1 level. Data representing print signal SI is composed of an 8-bit nozzle group designating flag, 180-bit upper bit data, 180-bit lower bit data, and 32-bit waveform number data. The 8-bit nozzle group designating flag, shown in FIG. 13(D), is a flag designating which of the six nozzle groups 60*a*-60*f* of a single print head 60 the print signal is intended for. Upper bit data and lower bit data transferred after the head designating flag consists of upper bit data and lower bit data for a 2-bit print signal relating to all nozzles included in the one nozzle group. In this example, a single nozzle group contains 180 nozzles, and accordingly the upper bit data and lower bit data are each composed of 180 bits. As described previously with reference to FIGS. 10(A)-10(H), print signals SI in this example represent any of four dot recording states, i.e. dots of three different sizes (small, medium, large) or no dot, and thus a single pixel print signal SI for a single nozzle is composed of 2 bits. However, where a print signal SI need only indicate presence or absence of a dot, a single pixel print signal SI may consist of one bit only. Where five or more dot recording modes are indicated, single pixel print signal SI may consist of 3 or more bits. Dot recording state is herein also termed ink ejection state. The 32-bit waveform number which is transferred last is the waveform number of the common drive signal COM. It is possible to omit waveform number.

Figures 14A, 14B, 14C, 14D:
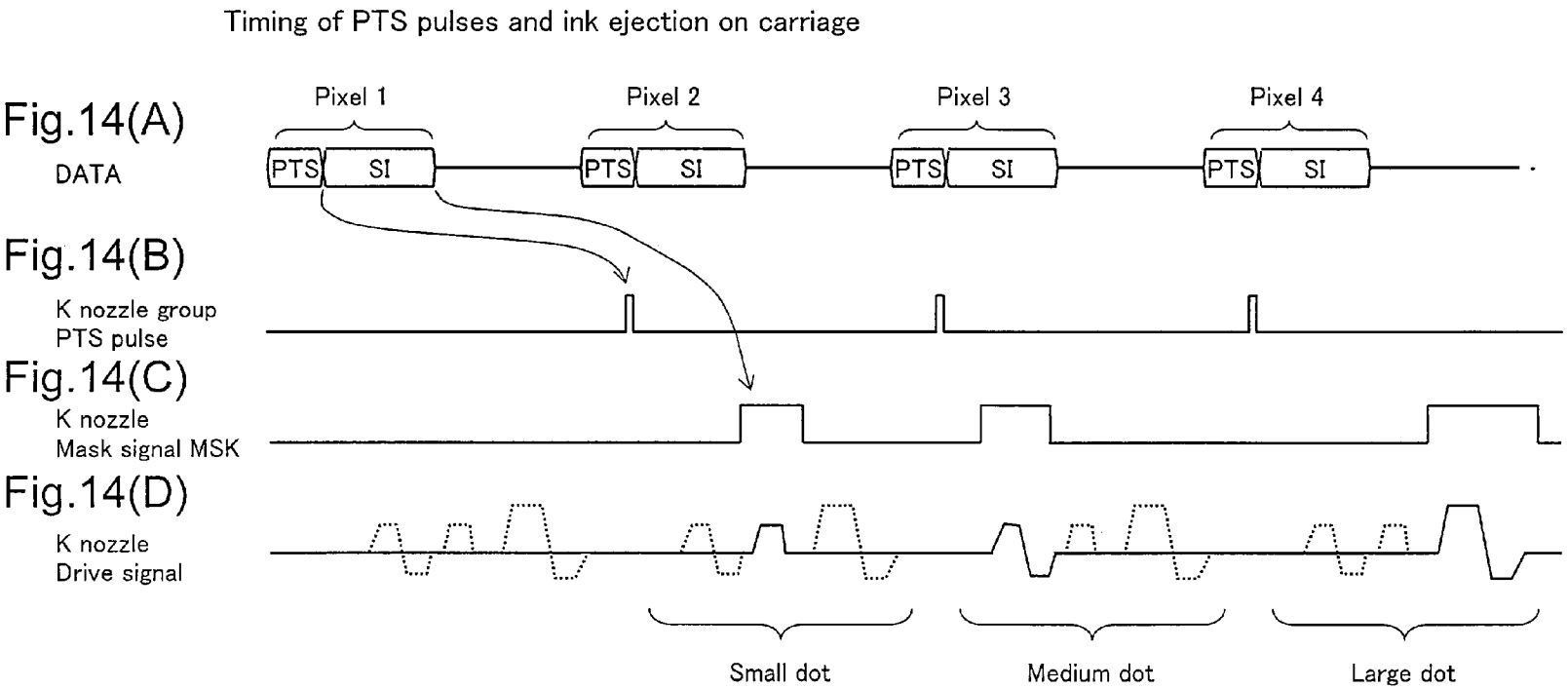
FIGS. 14(A)-14(D) are timing charts showing the timing for ink ejection.

Once a print timing signal PTS and print signal SI for a single nozzle group have been transferred in this way, each nozzle of the nozzle group produces an ink dot on a single pixel. FIGS. 14(A)-14(D) are timing charts showing the timing for ink ejection. As shown in FIG. 14(A), a print timing signal PTS for the initial single pixel produced by the black nozzle group is transferred to the carriage-side control circuit 500 according to the procedure shown in FIGS. 13(A)-13(D), whereupon the PTS pulse generating circuit (FIG. 8) generates a PTS pulse (FIG. 14(B)) after a predetermined delay interval. In response to this PTS pulse, mask signal generating circuit 504 (FIG. 8) generates a mask signal MSK (FIG. 14(C)) from the print signal SI, and presents it to the black nozzle driver circuit 61*a* (FIG. 8). Switching elements (not shown) for the nozzles, provided in driver circuit 61*a*, perform ON/OFF control of common drive signal COM in response to mask signal MSK, to generate a single-pixel drive signal for each nozzle (FIG. 14(D)). Ink drops are ejected from the 180 nozzles of black nozzle group 60*a* in response to the drive signals.

In this way, each time that a print timing signal PTS and print signal SI are supplied from chassis-side circuitry to carriage-side circuitry, formation of dots for one pixel is performed by the nozzles of the black nozzle group. FIG. 14(A) shows only the timing for transfer of data for the black nozzle group; in actual practice, signals PTS, SI for the other five nozzle groups are sequentially executed in intervals between transfer of signals PTS, SI relating to the black nozzle group of FIG. 14(A). Thus, the frequency of the clock signal SCLK, which stipulates transfer speed between chassis-side circuitry and carriage-side circuitry, is set to a frequency sufficiently high to perform such transfer (several tens to several hundred MHz). In this example, serial data is transmitted according to such a high frequency clock, so transmission of signals by a differential format is especially preferred.

In this embodiment, the chassis-side circuitry for use by the print heads 60 and the carriage-side circuitry are connected by flexible cable 340 containing 3 sets of signal line pairs for transmitting a 1-bit clock signal SCLK, flag signal FLG, and data signal DATA, enabling various data and signals to be transmitted between the chassis-side circuitry and the carriage-side circuitry at high speed. In particular, during printing, the print timing signal PTS which stipulates the timing of dot formation for one pixel, is transferred from chassis-side circuitry to carriage-side circuitry for each nozzle group, so that appropriate print timing can be stipulated for a large number of nozzle groups provided to a large number of print heads.

Figure 15:
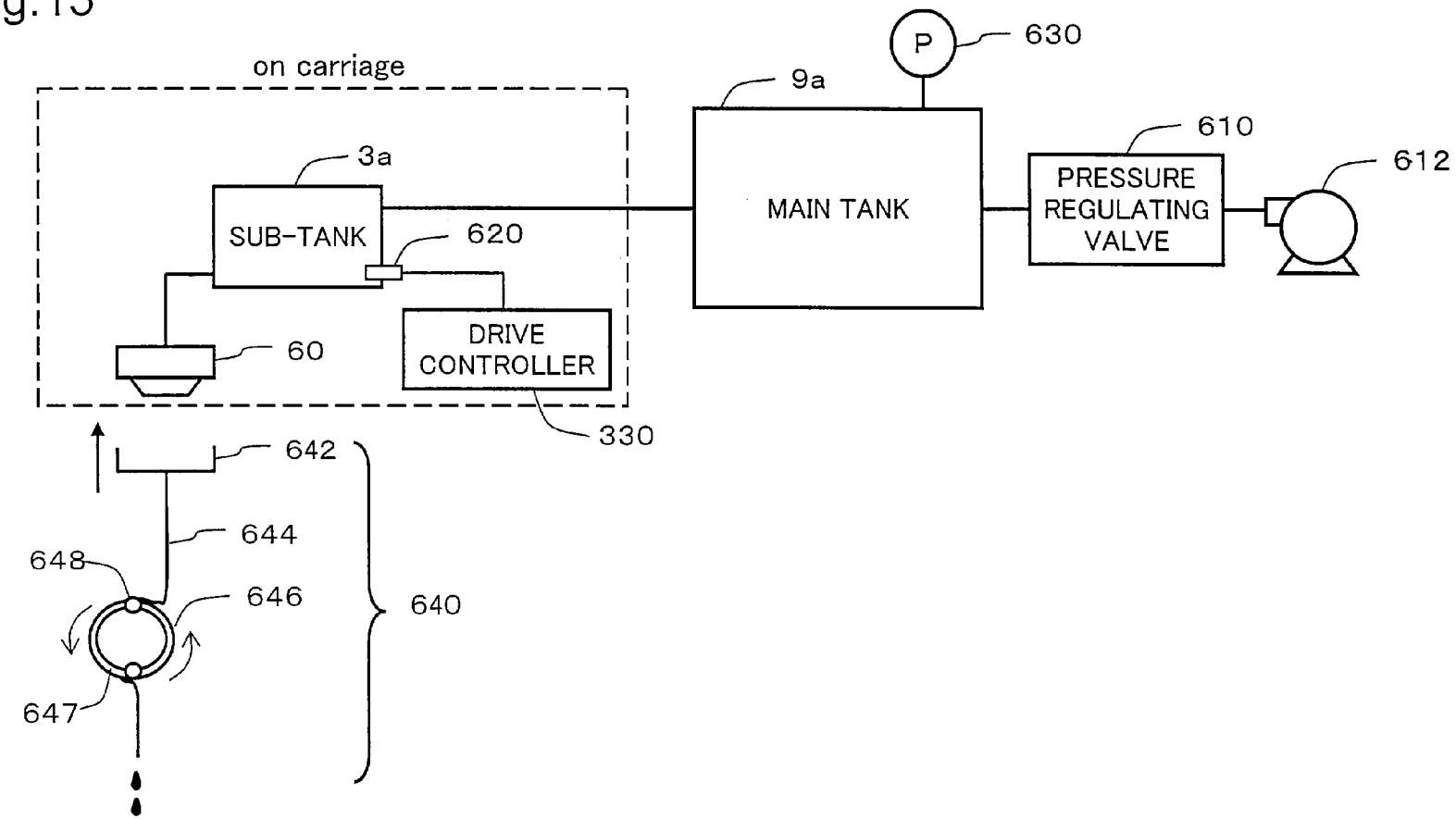
FIG. 15 illustrates the arrangement of an ink system.

C. Communication of Ink Quantity Information:

FIG. 15 is an illustration showing the configuration of an ink system in printer 200 of this embodiment. This ink system has, in addition to the sub-tanks 3*a* and main tanks 9*a* described previously, a pressure regulating valve 610 and a pressure pump 612. The pressure regulating valve 610 and pressure pump 612 are used when replenishing the sub-tanks 3*a* with ink from the main tanks 9*a*. Sub-tank 3*a* has a remaining ink quantity sensor 620, and main tank 9*a* has a pressure sensor 630.

This ink system further comprises a head suctioning unit 640 for cleaning the print head 60. The head suctioning unit 640 comprises a cap 642 for hermetically closing the bottom face of the print head 60, a suction hose 644, and a suction pump mechanism 646. Cap 642 corresponds to cap 21 shown in FIG. 2. Suction pump mechanism 646 is composed of a rotary ring 647. Suction hose 644 is wound around the outside circumference of the rotary ring, which is provided with projections at two locations on its outside circumference. During cleaning of the print head 60, cap 642 hermetically closes the bottom face of the print head 60, and in this state the rotary ring 647 is driven to rotate by a motor, not shown. Air inside the suction hose 644 and ink are scraped off by the projections 648 in this way, and ink is sucked out from the multitude of nozzles of print head 60, and discharged to the outside.

The head suctioning unit 640 is provided for each single print head 60, and can be installed and removed as a single unit from printer 200. In other words, a plurality of suction unit mountable positions are prepared in advance in the printer chassis. It is therefore possible to install head suctioning units 640 in number equal to the number of print heads 60 installed in the printer 200, which has the advantage that there is no need to provide unneeded head suctioning units 640 that will not be used.

Figure 16:
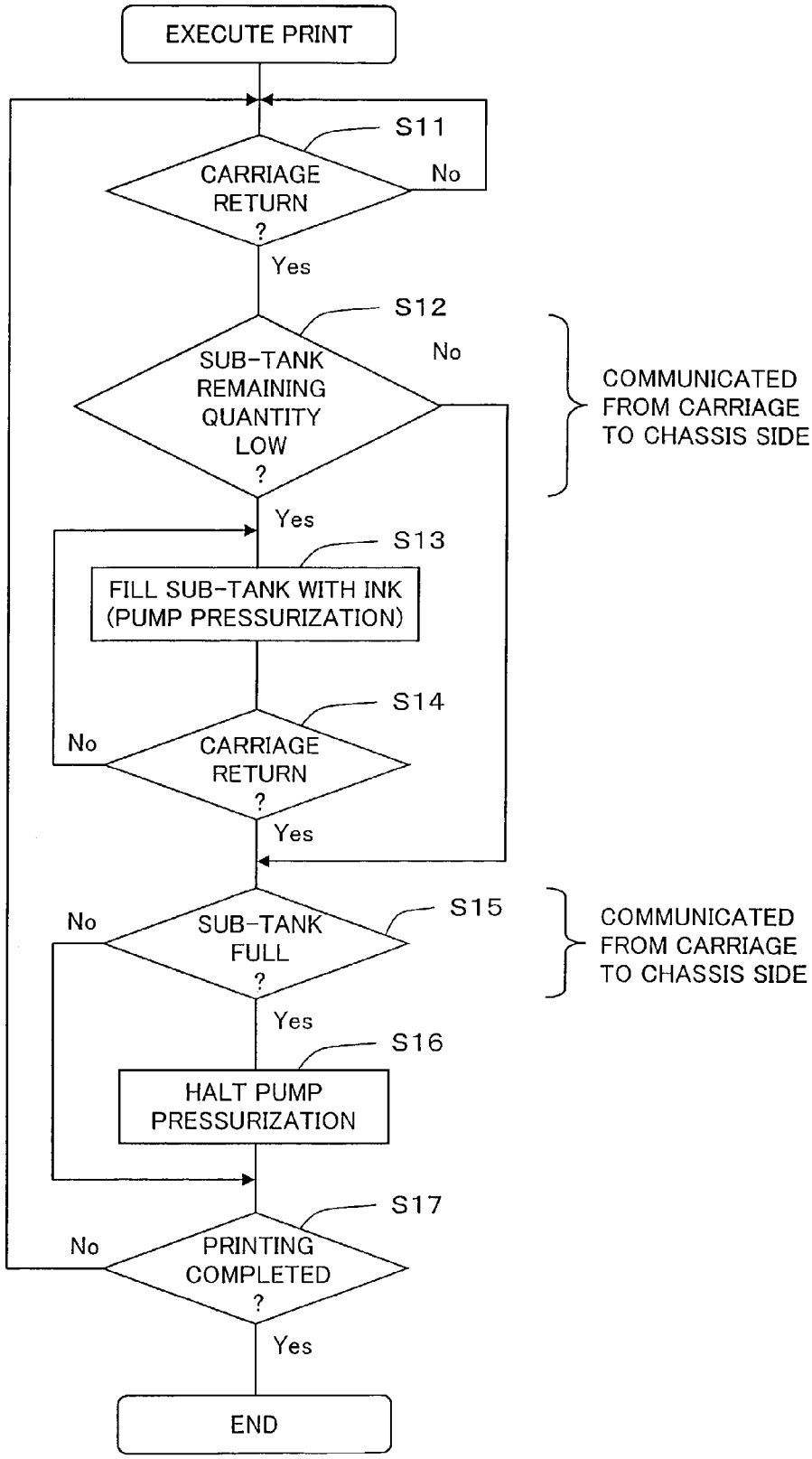
FIG. 16 is a flow chart showing the procedure for communication information relating to ink quantity between the carriage side and the chassis side in the ink system of FIG. 15.

FIG. 16 is a flow chart showing the procedure for communication information relating to ink quantity between the carriage side and the chassis side in the ink system of FIG. 15. In Step S11, the main controller 310 (FIG. 7) determines whether the carriage is returning from an outgoing pass to a return pass. In the arrangement described previously with reference to FIG. 1, carriage return from an outgoing pass to a return pass occurs when the carriage 1 reaches the left edge. If there is no carriage return, the system returns to Step S11. In the description of FIG. 16, carriage return from an outgoing pass to a return pass shall be termed simply "carriage return."

In the event of a carriage return, in Step S12, the drive controller 330 (FIG. 15) on the carriage acquires the remaining ink quantity from the remaining ink quantity sensor 620 of sub-tank 3*a*, and transmits it to the chassis-side data processor 320 (FIG. 7). Data processor 320 then transmits remaining ink quantity to the main controller 310. Acquisition and transfer of remaining ink quantity is performed for each sub-tank mounted on carriage 1. Main controller 310 then determines whether remaining ink quantity has fallen below a predetermined level; if remaining ink quantity is above this predetermined level, the system moves to Step S15 described later. If remaining ink quantity is below the predetermined level, in Step S13, the main controller 310 initiates an operation to fill the sub-tank 3*a* with ink. Specifically, pressure pump 612, pressure regulating valve 610, and pressure sensor 630 are used to maintain the main tank 9*a* at a predetermined, relatively high level of pressure, whereby ink is supplied from the main tank 9*a* to the sub-tank 3*a*.

After the ink filling operation has been initiated, when the next subsequent carriage return occurs (Step S14), remaining ink quantity is transferred from drive controller 330 to data processor 320, and then to main controller 310 (Step S15). On the basis of this remaining ink quantity, main controller 310 determines whether sub-tank 3*a* is full. If sub-tank 3*a* is full, pressurization by pump 612 is halted in Step S16. On the other hand, if not fully, the ink filling operation continues. If printing has not yet finished (Step S17), the system returns to Step S11, and repeats the operation of Steps S11-S16 described above.

In this way, by processing routine of FIG. 16, remaining ink quantity in a sub-tank 3*a* is communicated from the carriage side to the chassis side during carriage return from an outgoing pass to a return pass. Since no print signals are communicated during carriage returns, a resultant advantage is that printing operations are not impaired by communication of remaining ink quantity.

Figure 17:
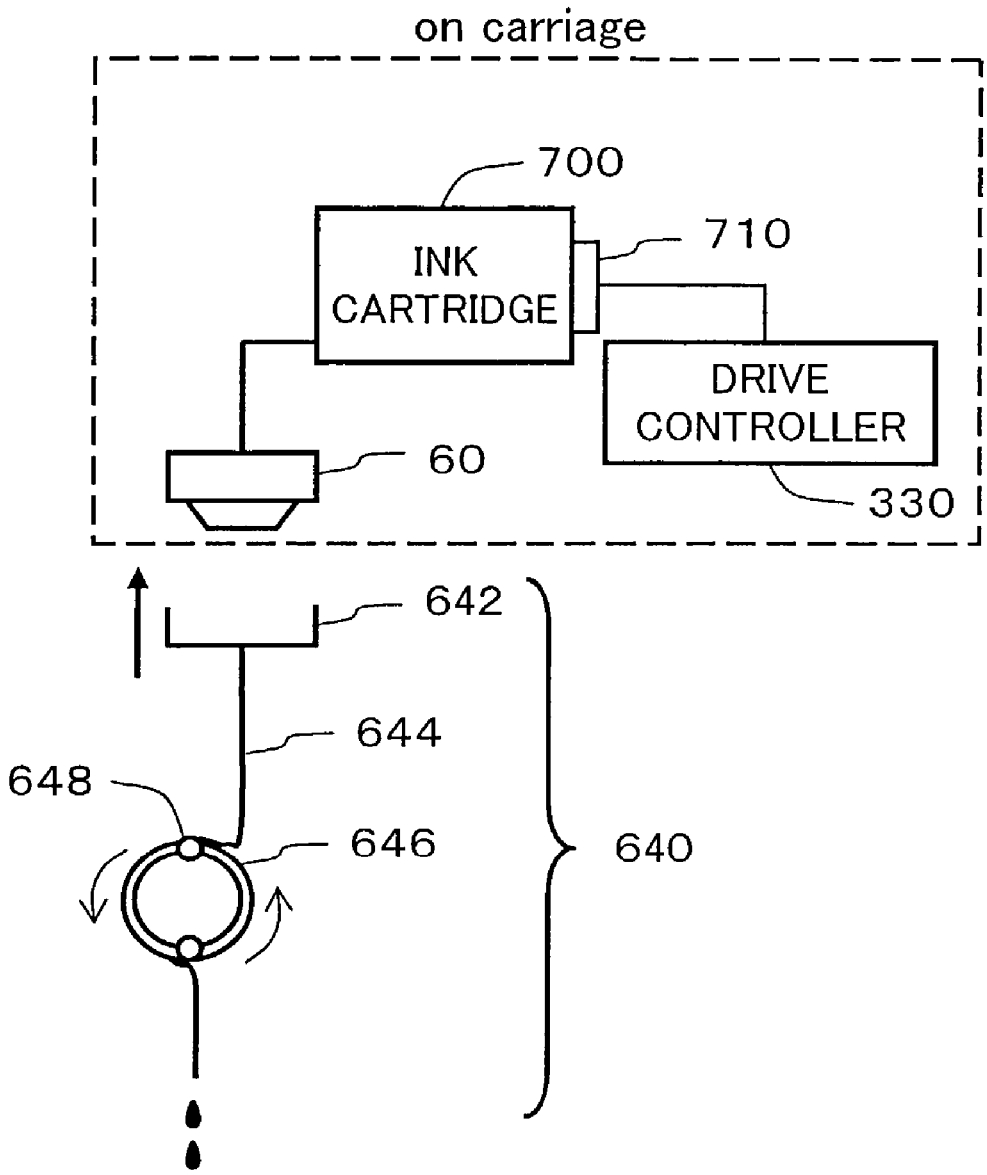
FIG. 17 illustrates another arrangement for the ink system.

FIG. 17 is an illustration of another arrangement for the ink system. This ink system lacks a sub-tank 3*a* and main tank 9*a*; instead, an ink cartridge 700 for each print head 60 is installed on carriage 1. Thus, the pressure regulating valve 610 and pressure pump 612 shown in FIG. 15 are absent as well. Ink cartridge 700 has an IC memory 710 for storing information relating to the ink cartridge, including remaining ink quantity. When all of the ink in an ink cartridge 700 has been consumed, it is replaced with a new cartridge.

Figure 18:
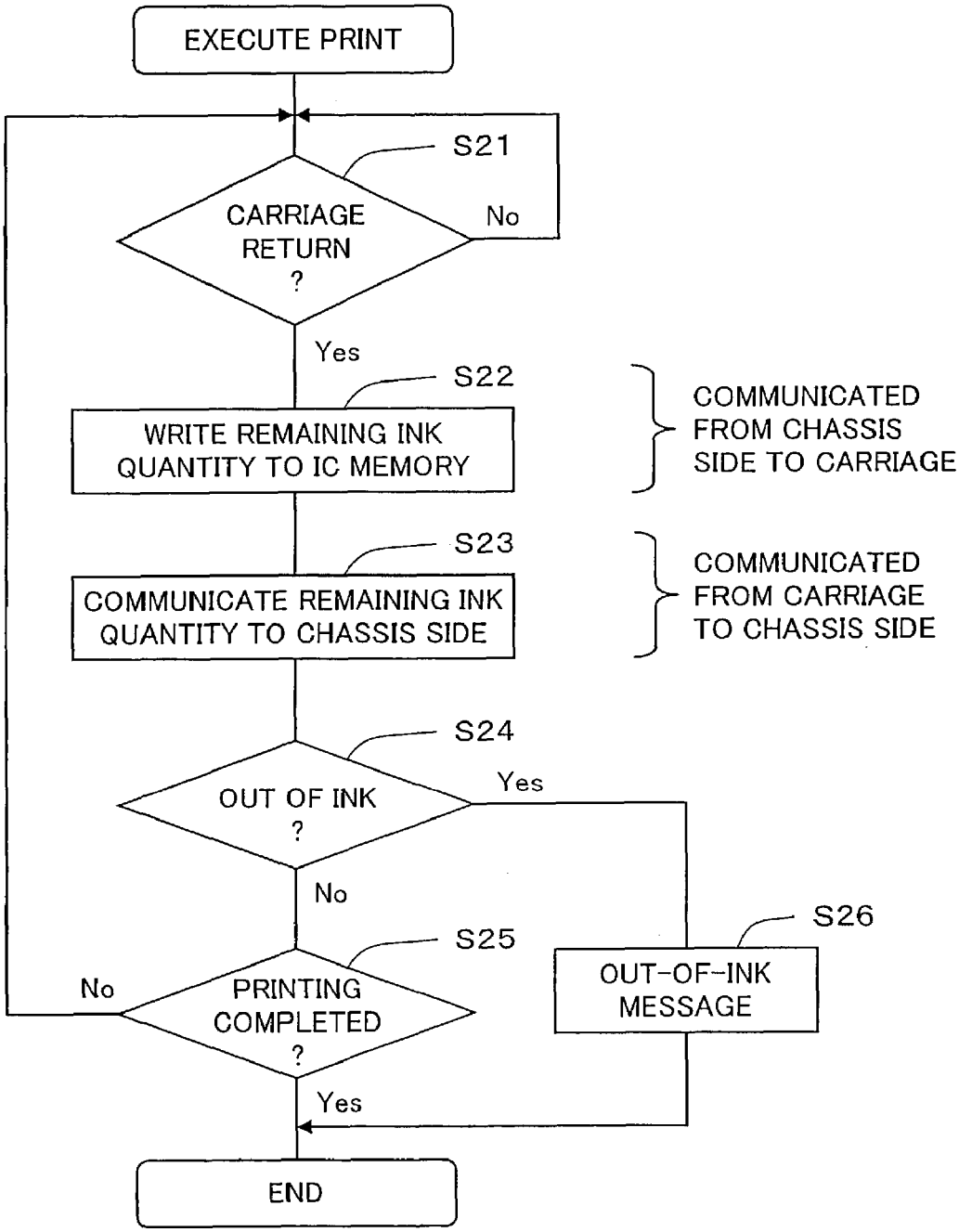
FIG. 18 is a flow chart of a routine when communication information relating to ink quantity between the chassis side and cartridge side in the ink system of FIG. 17.

FIG. 18 is a flow chart of a routine when communication information relating to ink quantity between the chassis side and cartridge side in the ink system of FIG. 17. In Step S21, main controller 310 determines whether the carriage is returning from an outgoing pass to a return pass. Step S21 is a process analogous to Step S11 in FIG. 16.

In the event of a carriage return, in Step S22, the main controller 310 transfers ejected ink quantity (quantity of ink used) from ink cartridge 700 to drive controller 320 via data processor 320. This ejected ink quantity can be calculated by adding up the total number of drops of ink ejected from cartridge 700 (this is determined on the basis of print signals used for printing up to that point in time) and multiplying this value by ink drop weight. Drive controller 320 then divides ejected ink quantity from the remaining ink quantity read out from IC memory 710 of cartridge 700, and writes the updated remaining ink quantity to IC memory 710.

In Step S23, drive controller 330 notifies the main controller 310 of the updated remaining ink quantity via data processor 320. In Step S24, main controller 310 determines whether an out-of-ink condition exists (i.e. whether the remaining ink quantity in cartridge 700 has fallen below a predetermined level). In the event that an out-of-ink condition is determined to exist, printing is suspended temporarily and an out-of-ink message is displayed on the display section (not shown) of printer 200 in Step S26. If an out-of-ink condition does not exist, the system returns from Step S25 to Step S21, and repeats the operation of Steps S21-S24 described above.

In this way, in the example of FIG. 18 as well, ejected ink quantity and remaining ink quantity are communicated during carriage returns, which has the advantage that printing operations are not hampered by this communication.

In the examples of FIGS. 16 and 18, the timing for communication remaining ink quantity coincides with carriage return from an outgoing pass to a return pass; however communication could instead coincide with carriage return from a return pass to an outgoing pass. During either carriage return, carriage 1 is present in one of two nonprintable areas located to either side of the nonprintable areas located at both ends of the area through which carriage 1 can move. That is, communication of remaining ink quantity preferably takes place when the carriage is situated in either of two nonprintable areas.

The information communicated during carriage returns is not limited to remaining ink quantity and ejected ink quantity; communicated information may consist of any information relating to ink quantity in an ink tank (i.e. a sub-tank 3*a* or cartridge 700) installed on carriage 1 (hereinafter termed "ink quantity-related information").

In the examples of FIGS. 16 and 18, ink quantity-related information is communicated during each single carriage return, but ink quantity-related information could instead be communicated each time that a predetermined plurality of carriage returns has been completed. Alternatively, ink quantity-related information could instead be communicated when printing of one page has been completed.

D. Variations

D1. Variation 1:

Bit numbers and bit arrangements of the various signals described in the preceding embodiment are merely exemplary; various other bit numbers and/or bit arrangements may be employed instead. For example, each signal line of flexible cable 340 has been described as transmitting a 1-bit signal, but the data signal line DATA could instead be designed to transmit a data signal of 2 or more bits. However, using 1-bit serial signals as the signals transmitted through flexible cable 340 as in the example hereinabove allow the flexible cable 340 to be reduced in size, which has the advantage of facilitating routing of a large number of cables. Also, 1-bit serial transmission has the advantage of error-free transmission at higher frequencies.

D2. Variation 2:

In the above embodiment, a print timing signal PTS is generated once each time that the nozzles of a single nozzle group form dots for single pixels, but instead of this, a print timing signal PTS could be generated once each time that nozzles of a plurality of nozzle groups provided to a single print head 60 form dots for single pixels. For example, where a single print head 60 has six nozzle groups, in the latter case, the frequency with which print timing signals PTS are generated will be one-sixth that in the former case. The print timing lag for a plurality of nozzles provided to a single print head 60 will be a time interval corresponding to the distance between nozzle groups in the main scanning direction, divided by the main scanning speed (carriage speed). Accordingly, once print timing for the lead nozzle group is known, print timing for the other nozzle groups of the print head can be calculated from the distance between nozzle groups. This print timing lag is pre-registered in the drive controller 330, so that print timing can be determined for the nozzle groups other than the lead nozzle groups with reference to this lag.

D3. Variation 3:

In the above embodiment, all nozzles belonging to the same nozzle group eject the same ink, but it would be possible to have a number of nozzles ejecting different inks arranged in a single nozzle group. Alternatively, a number of nozzles ejecting the same ink could be divided into two or more nozzle groups. As will be understood from these examples, the method of dividing nozzle groups is to some extent arbitrary. However, where ink types (i.e. ink color, pigment vs. dye, etc.) differ; the appropriate drive waveform may also differ in some instances. In such instances, having all of the nozzles belonging to a given nozzle group eject the same ink, as in the embodiment hereinabove, has the advantage that the most suitable drive waveform for each ink can be selected.

D4. Variation 4:

In the example hereinabove, some of the functions accomplished by means of hardware could instead be performed by software, and conversely, some of the functions accomplished by means of software could instead be performed by hardware. For example, some of the chassis-side data processor 320 and drive controller 330 (FIG. 8) functions could be performed by means of a computer program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing device for effecting printing by ejecting ink from print head, comprising:

a plurality of head unit mountable positions on which a plurality of head units are mountable, each head unit including a predetermined number of print heads equal to one or greater and a drive controller for driving the predetermined number of print heads in the head unit, a carriage on which the plurality of head unit mountable positions are formed;

a plurality of on-carriage ink reservoirs, disposed on the carriage, for supplying ink to the print heads; and a plurality of off-carriage ink tanks, disposed on a body of the printing device, for supplying ink to the on-carriage ink reservoirs;

wherein each head unit including the print heads and the drive controller is individually installed and uninstalled on the printing device; and wherein the printing device further comprises a chassis having a plurality of data processor mountable positions on which a data processor for transferring data to a corresponding on of the drive controllers is mountable;

wherein each data processor and each corresponding drive controller are interconnected by a flexible cable that includes a clock signal line for transmitting a clock signal, a flag signal line for transmitting a flag signal, and a serial data line for transferring serial data:

wherein each data processor and each corresponding drive controller can selectively transmit through the flexible cable:

(i) drive signal waveform data representing a drive signal waveform for driving print heads, (ii) a print timing signal for notifying of ink ejection timing, and (iii) a print signal indicating ink ejection status from each nozzle; and wherein each data processor and each corresponding drive controller do not communicate for transmitting print signals during carriage returns, and wherein each data processor and each corresponding drive controller do communicate for transmitting ink quantity information during carriage returns.

2. A printing device according to claim 1, further comprising a plurality of data processor mountable positions on which a data processor for transferring data to a corresponding one of the drive controllers is mountable.

3. A printing device according to claim 1 wherein plural types of head units are available such that any type of head unit is selectable for any head unit position.

4. A printing device according to claim 1, wherein the print timing signal is transmitted from the data processor to the drive controller each time that ink for one pixel is ejected from nozzles in a single nozzle group disposed on a single print head.

5. A printing device according to claim 4 wherein the print timing signal relating to a single nozzle group is followed by transmission from the data processor to the drive controller of a print signal indicating ink ejection status from each nozzle of the nozzle group.

6. A printing device according to claim 1, wherein the flexible cable includes only the clock signal line, the flag signal line, and the serial data line as signal lines for transmitting changes in signal level between the data processor and the drive controller.

7. A printing device according to claim 1, wherein the clock signal line, the flag signal line, and the serial data line are each constituted as a signal line pair for transmitting signals by a differential format.

8. A printing device according to claim 1, wherein the data processor and the drive controller communicate information relating to ink quantity in an ink tank disposed on the carriage at times that the carriage is situated in either of two nonprintable areas located at both ends of movable area through which the carriage can move.

9. A printing device according to claim 1, further comprising a plurality of suction unit mountable positions on which a plurality of head suctioning units for cleaning nozzles of a single print head by suctioning out ink from the print head are mountable.

10. A printing device according to claim 1, further comprising:

a sensor for detecting a remaining ink quantity of each of the plurality of on-carriage ink reservoirs;

wherein if the remaining ink quantity of an on-carriage ink reservoir is below a predetermined level, the on-carriage ink reservoir is refilled from a corresponding off-carriage ink tank.

11. A printing device according to claim 1, wherein the carriage comprises a plurality of reservoir mounting plates, and the plurality of on-carriage ink reservoirs are distributed to and installed on the plurality of reservoir mounting plates.

* * * * *